US010453406B2

(12) United States Patent
Jang et al.

(10) Patent No.: US 10,453,406 B2
(45) Date of Patent: Oct. 22, 2019

(54) DISPLAY DEVICE, DRIVING CONTROLLER, AND DRIVING METHOD

(71) Applicant: LG Display Co., Ltd., Seoul (KR)

(72) Inventors: SuHyuk Jang, Gyeonggi-do (KR); JaeWoo Lee, Gyeonggi-do (KR); HyeJin Kim, Gyeonggi-do (KR); KyoungKoo Lee, Gyeonggi-do (KR); Jinwon Lee, Gyeonggi-do (KR); Hyojin Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 8 days.

(21) Appl. No.: 15/846,062

(22) Filed: Dec. 18, 2017

(65) Prior Publication Data

US 2018/0190218 A1 Jul. 5, 2018

(30) Foreign Application Priority Data

Dec. 29, 2016 (KR) ..... 10-2016-0182527

(51) Int. Cl.

| | |
|---|---|
| ***G09G 3/36*** | (2006.01) |
| ***G09G 3/00*** | (2006.01) |
| ***G09G 3/20*** | (2006.01) |

(52) U.S. Cl.

CPC ..... *G09G 3/3611* (2013.01); *G09G 3/006* (2013.01); *G09G 3/2096* (2013.01); *G09G 3/3607* (2013.01); *G09G 2310/08* (2013.01); *G09G 2330/021* (2013.01); *G09G 2330/12* (2013.01); *G09G 2370/08* (2013.01)

(58) Field of Classification Search

CPC ..... G09G 2310/08; G09G 2330/021; G09G 2330/12; G09G 2370/08; G09G 3/006; G09G 3/2096; G09G 3/3607; G09G 3/3611

See application file for complete search history.

(56) References Cited

U.S. PATENT DOCUMENTS

| | | | | |
|---|---|---|---|---|
| 8,493,373 | B2 | 7/2013 | Jeon et al. | |
| 8,847,941 | B2 | 9/2014 | Tanaka et al. | |
| 9,208,732 | B2 | 12/2015 | Kim et al. | |
| 2006/0197730 | A1 | 9/2006 | Ooga et al. | |
| 2010/0225637 | A1 | 9/2010 | Jeon et al. | |
| 2011/0234574 | A1* | 9/2011 | Tanaka | G09G 3/2096 345/211 |

(Continued)

FOREIGN PATENT DOCUMENTS

| | | | |
|---|---|---|---|
| CN | 101192363 | A | 6/2008 |
| JP | 2008-009108 | A | 1/2008 |

(Continued)

OTHER PUBLICATIONS

Extended European Search Report, European Patent Application No. 17206344.8, dated Jun. 15, 2018, 9 pages.

(Continued)

*Primary Examiner* — Viet D Pham

(74) *Attorney, Agent, or Firm* — Fenwick & West LLP

(57) ABSTRACT

A display device, a driving controller, and a driving method provide a fail-safe function. The operating states of driving-related circuits are monitored, and depending on the result of the monitoring, abnormal driving is rapidly and accurately normalized. The performance of display driving and the quality of displayed images are improved.

26 Claims, 20 Drawing Sheets

(56) References Cited

U.S. PATENT DOCUMENTS

| | | | | |
|---|---|---|---|---|
| 2012/0147195 | A1 | 6/2012 | Jang et al. | |
| 2013/0050176 | A1 | 2/2013 | Kim et al. | |
| 2014/0184659 | A1 | 7/2014 | Kang et al. | |
| 2015/0325212 | A1 | 11/2015 | Gomez et al. | |
| 2016/0078804 | A1* | 3/2016 | Cho | G09G 3/3225 345/213 |
| 2016/0365051 | A1* | 12/2016 | Jung | G09G 3/3406 |
| 2018/0144723 | A1* | 5/2018 | Lim | G09G 5/18 |

FOREIGN PATENT DOCUMENTS

| | | | |
|---|---|---|---|
| JP | 2009-025426 | A | 2/2009 |
| JP | 2010-107933 | A | 5/2010 |
| JP | 2010-204667 | A | 9/2010 |
| JP | 2012-054700 | A | 3/2012 |
| JP | 2013-160999 | A | 8/2013 |
| TW | 201310434 | A1 | 3/2013 |

OTHER PUBLICATIONS

First Taiwanese Office Action, Taiwan Patent Application No. 106142267, dated Aug. 20, 2018, 7 pages.

Japanese Office Action, Japanese Patent Application No. 2017-236655, dated Nov. 7, 2018, 11 pages.

* cited by examiner

DISPLAY DEVICE, DRIVING CONTROLLER, AND DRIVING METHOD

CROSS REFERENCE TO RELATED APPLICATION

This application claims priority under 35 U.S.C. § 119(a) of Republic of Korea Patent Application No. 10-2016-0182527, filed on Dec. 29, 2016, which is hereby incorporated by reference in its entirety.

BACKGROUND

Technical Field

The present disclosure relates to a display device, a driving controller, and a driving method.

Discussion of Related Art

In response to the development of the information society, there has been increasing demand for display devices able to display images. Recently, a range of display devices, such as liquid crystal display (LCD) devices, plasma display panels (PDPs), and organic light-emitting display devices, have come into widespread use.

Such a display device includes a display panel, a plurality of driver circuits driving the display panel, and a driving control circuit controlling the driver circuit.

A plurality of driver circuits and a driving control circuit must operate ordinarily so that a display device can properly display images on the screen.

Thus, an abnormal image may be displayed on the screen in the case in which any one of a plurality of circuits, including the plurality of driver circuits and a driving control circuit, fails to operate ordinarily.

However, in related-art display devices, technology for effectively monitoring the operating states of driving-related circuits, and in a case in which any one of the circuits malfunctions, rapidly and accurately normalizing the operation of the corresponding circuit has not yet been developed.

SUMMARY

Various aspects of the present disclosure provide a display device, a driving controller, and a driving method that can effectively and accurately monitor the operating states of driving-related circuits, and when an abnormality has been occurred in one of the circuits, to rapidly and accurately normalize the operation of the corresponding circuit.

Also provided are a display device, a driving controller, and a driving method that can normalize an abnormal gate driving state by accurately and rapidly monitoring the gate driving state.

Also provided are a display device, a driving controller, and a driving method that can normalize an abnormal video input state by accurately and rapidly monitoring the video input state.

Also provided are a display device, a driving controller, and a driving method that can normalize an abnormal driving control internal logic by accurately and rapidly monitoring the driving control internal logic.

Also provided are a display device, a driving controller, and a driving method that can normalize an abnormal source driving state by accurately and rapidly monitoring the source driving state.

Also provided are a display device, a driving controller, and a driving method that can improve the quality of images by performing synthetic, systemized, and robust fail-safe processing on a number of display driving elements influential in displaying images on the screen.

Also provided are a display device, a driving controller, and a driving method that can improve the quality of overall images of the display panel by rapidly monitoring an abnormal state in both row driving and column driving of the display panel, and responsive to detecting an abnormal state, rapidly normalizing the abnormal driving state.

According to an aspect of the present disclosure, a display device may include a display panel having an arrangement of a plurality of data lines and an arrangement of a plurality of gate lines, a source driver circuit driving the plurality of data lines, a gate driver circuit driving the plurality of gate lines, and a driving controller. The driving controller is configured for outputting a frame start signal to the gate driver circuit for a first frame. The driving controller is further configured for, responsive to determining that a first feedback signal received in a first frame blank section of the first frame is in a first state, outputting a second frame start signal for a second frame to the gate driver circuit. The driving controller is further configured for, responsive to determining that a second feedback signal has not been received in a second frame blank section for a third frame or the received second feedback signal is in a second state, not outputting a third frame start signal for a fourth frame to the gate driver circuit.

After the first frame start signal for the first frame is output, responsive to determining that the first feedback signal received in the first frame blank section is in the first state, the driving controller may output the second frame start signal for the second frame.

After the first frame start signal for the first frame is output, responsive to determining that the first feedback signal has not been received in the first frame blank section or the received first feedback signal is in the second state, the driving controller may not output the second frame start signal for the second frame.

According to another aspect of the present disclosure, a driving controller may include a control signal output circuit outputting a first frame start signal for a first frame, and a controller configured for receiving a first feedback signal in a first frame blank section of the first frame. The controller controls whether to output a second frame start signal for a second frame, depending on whether the first feedback signal has been received or based on the state of the first feedback signal.

After the first frame start signal for the first frame is output, the controller may output the second frame start signal for the second frame responsive to determining that the first feedback signal received in the first frame blank section is in a first state and may not output the second frame start signal for the second frame when the first feedback signal has not been received in the first frame blank section or the received first feedback signal is in a second state.

According to another aspect of the present disclosure, provided is a method of driving a display device including a display panel having an arrangement of a plurality of data lines and an arrangement of a plurality of gate lines, a source driver circuit driving the plurality of data lines, and a gate driver circuit driving the plurality of gate lines.

The method may include a step in which a driving controller outputs a first frame start signal for a first frame The method further includes a step in which the driving controller waits a duration of time for a first feedback signal to be received in a first frame blank section of the first frame. The method further includes a step in which the driving controller outputs a second frame start signal for a second frame responsive to determining that the first feedback signal received in the first frame blank section is in a first state and does not output the second frame start signal for the second frame responsive to determining that the first feedback signal has not been received in the first frame blank section or the received first feedback signal is in a second state.

According to another aspect of the present disclosure, a display device may include a display panel having an arrangement of a plurality of data lines and an arrangement of a plurality of gate lines, a source driver circuit driving the plurality of data lines, a gate driver circuit driving the plurality of gate lines, and a driving controller controlling the source driver circuit and the gate driver circuit.

After an abnormal screen image is displayed on the display panel, the driving controller may output first data causing a screen image different from the abnormal screen image to be displayed on the display panel. The driving controller may output second data causing a normal screen image to be displayed on the display panel, in response to checking a signal received from the display panel, the gate driver circuit, or the source driver circuit.

According to another aspect of the present disclosure, a driving controller may include, a video signal receiver receiving a video signal, a data output circuit outputting video data converted from the video signal, and a control signal output circuit outputting a control signal to control display driving.

After an abnormal screen image is displayed on the display panel, the data output circuit may output data causing a screen image different from the abnormal screen image to be displayed on the display panel, in response to checking a signal received from the display panel, the gate driver circuit, or the source driver circuit.

According to some embodiments, the driving controller effectively and accurately monitors the operating states of the driving-related circuits, and responsive to determining that an abnormality has occurred in one of the circuits, to rapidly and accurately normalize the operation of the corresponding circuit.

According to some embodiments, the driving controller normalizes an abnormal gate driving state by accurately and rapidly monitoring the gate driving state.

According to some embodiments, the driving controller normalizes an abnormal video input state by accurately and rapidly monitoring the video input state.

According to some embodiments, the driving controller normalizes an abnormal driving control internal logic by accurately and rapidly monitoring the driving control internal logic.

According to some embodiments, the driving controller normalizes an abnormal source driving state by accurately and rapidly monitoring the source driving state.

According to some embodiments, the driving controller improves the quality of images by performing synthetic, systemized, and robust fail-safe processing on a number of display driving elements influential in displaying images on the screen.

According to some embodiments, the driving controller improves the quality of overall images of the display panel by rapidly monitoring an abnormal state in row driving or column driving of the display panel.

BRIEF DESCRIPTION OF THE DRAWINGS

The above and other objects, features and advantages of the present disclosure will be more clearly understood from the following detailed description when taken in conjunction with the accompanying drawings, in which.

DETAILED DESCRIPTION

Figure 1:
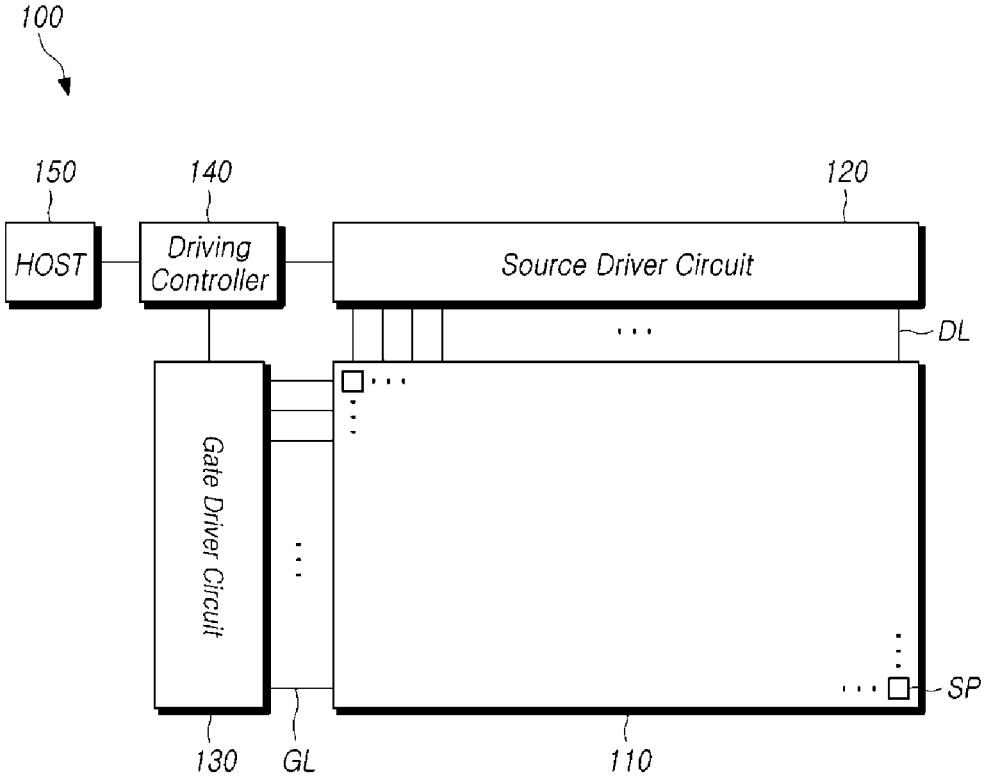
FIG. 1 illustrates a system configuration of a display device according to an embodiment.

Embodiments of the present disclosure relate to a display device, a driving controller, and a driving method that provides a fail-safe function to monitor the operating states of driving-related circuits and to rapidly and accurately normalize abnormal driving, depending on the result of the monitoring, thereby comprehensively improving the performance of display driving and the quality of displayed images.

Hereinafter, reference will be made to embodiments of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first," "second," "A," "B," "(a)," and "(b)" may be used herein to describe various elements, such terms are merely used to distinguish one element from another element. The substance, sequence, order, or number of these elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 illustrates a system configuration of a display device 100 according to an embodiment.

Referring to FIG. 1, the display device 100 according to an embodiment includes a display panel 110, a source driver circuit 120, a gate driver circuit 130, and a driving controller 140. The display panel 110 has an arrangement of a plurality of data lines DL, an arrangement of a plurality of gate lines GL, and an array of a plurality of subpixels SP at intersections of the plurality of data lines DL and the plurality of gate lines GL. The source driver circuit 120 drives the plurality of data lines DL. The gate driver circuit 130 drives the plurality of gate lines GL. The driving controller 140 controls the source driver circuit 120 and the gate driver circuit 130.

The driving controller 140 controls the source driver circuit 120 and the gate driver circuit 130 by transferring a variety of control signals to the source driver circuit 120 and the gate driver circuit 130, respectively.

In an embodiment the driving controller 140 starts scanning based on timing realized in each frame, converts image data input from an external source into a data signal format readable by the source driver circuit 120 before outputting converted image data, and regulates data processing at suitable points in time in response to the scanning.

The driving controller 140 may be a timing controller used in the field of display technology known to one skilled in the art, or a control device performing other control functions, including the function as the timing controller.

The driving controller 140 may be embodied as a component separate from the source driver circuit 120 or may be embodied as an integrated circuit (IC) together with the source driver circuit 120.

The source driver circuit 120 drives the plurality of data lines DL by supplying data voltages to the plurality of data lines DL. Herein, the source driver circuit 120 may also be referred to as a "data driver circuit."

The gate driver circuit 130 may sequentially drive the plurality of gate lines GL by sequentially transferring a scanning signal to the plurality of gate lines GL. Herein, the gate driver circuit 130 may also be referred to as a "scanning driver."

The gate driver circuit 130 may sequentially transfer a scanning signal having an on or off voltage to the plurality of gate lines GL, under the control of the driving controller 140.

When a specific gate line among the plurality of gate lines GL is opened by the gate driver circuit 130, the source driver circuit 120 converts image data received from the controller 140 into analog data voltages and supplies the analog data voltages to the plurality of data lines DL.

The source driver circuit 120 may be located on one side of (e.g., above or below) the display panel 110, as illustrated in FIG. 1. Alternatively, the source driver circuit 120 may be located on both sides of (e.g., above and below) the display panel 110, depending on the driving system, or the design of the display panel 110.

The gate driver circuit 130 may be located on one side (e.g., to the right or left) of the display panel 110, as illustrated in FIG. 1. Alternatively, the gate driver circuit 130 may be located on both sides (e.g., to the right and left) of the display panel 110, depending on the driving system, or the design of the display panel 110.

Regarding video input of video signals, the driving controller 140 may receive a variety of timing signals, including a vertical synchronization (Vsync) signal, a horizontal synchronization (Hsync) signal, an input data enable (DE) signal, a clock signal, etc., from an external source (e.g., a host 150 as shown in FIG. 1).

The driving controller 140 receives a variety of timing signals, such as a Vsync signal, an Hsync signal, an input DE signal, and a clock signal, generates a variety of control signals, such as a data driving control signal and a gate driving control signal, and outputs the variety of control signals to the source driver circuit 120 and the gate driver circuit 130 to control the source driver circuit 120 and the gate driver circuit 130, respectively.

For example, the driving controller 140 outputs a variety of gate control signals (GCSs), including a gate start pulse (GSP), a gate shift clock (GSC), a gate output enable (GOE) signal, and the like, to control the gate driver circuit 130.

Among these signals, the GSP controls the operation start timing of the gate driver circuit 130. The GSC is a clock signal input to the gate driver circuit 130 to control the shift timing of a scanning signal (or a gate pulse). The GOE signal designates information regarding the gate output timing of the gate driver circuit 130.

In addition, the driving controller 140 outputs a variety of data driving control signals, including a source start pulse (SSP), a source sampling clock (SSC), a source output enable (SOE) signal, and the like, to control the source driver circuit 120.

Among these signals, the SSP controls the data sampling start timing of the source driver circuit 120. The SSC is a clock signal controlling the sampling timing of data in the source driver circuit 120. The SOE signal controls the output timing of data of the source driver circuit 120.

Figure 2:
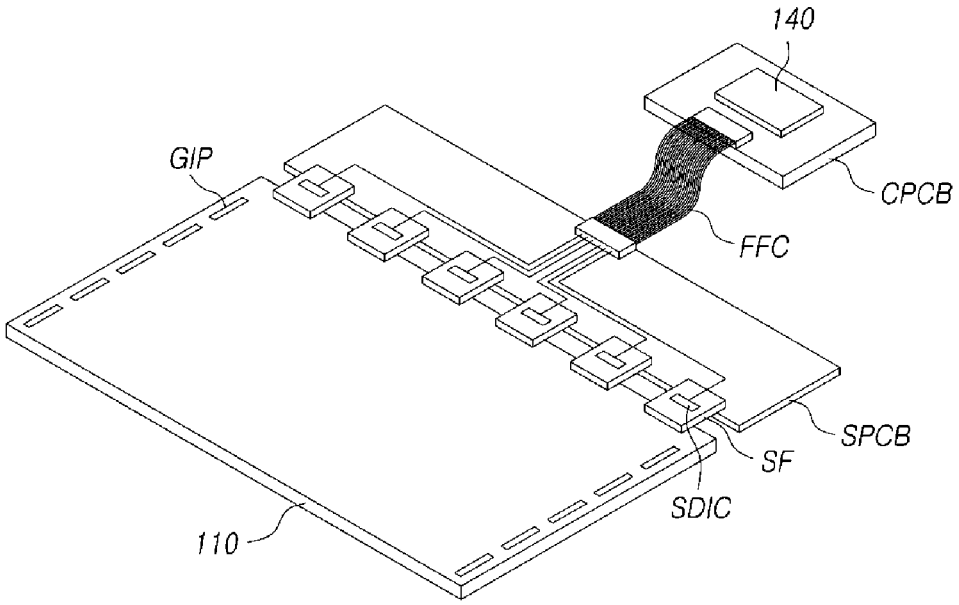
FIG. 2 is a perspective view of a display device according to an embodiment.

FIG. 2 is a perspective view of the display device 100 according to an embodiment.

The source driver circuit 120 includes one or more source driving ICs (SDICs) to drive the plurality of data lines DL. The source driving ICs may also be referred to as source driver chips.

The source driving ICs may be connected to bonding pads of the display panel 110 by tape-automated bonding (TAB) or by a chip-on-glass (COG) method, may be directly mounted on the display panel 110, or in some cases, may be integrated with the display panel 110.

As illustrated in FIG. 2, the source driving ICs may also be implemented as chip-on-film (COF) source driving ICs, which are mounted on circuit films SF connected to the display panel 110.

The gate driver circuit 130 includes one or more gate driver ICs (GDICs) to drive the plurality of gate lines GL. The DGICs are also referred to as gate driver chips (GIPs as shown in FIG. 2).

The gate driver ICs may be connected to the bonding pads of the display panel 110 by tape-automated bonding (TAB), a chip-on-glass (COG) method, or may be integrated with the display panel 110.

Alternatively, the gate driver ICs may also be implemented as chip-on-film (COF) gate driver ICs, which are mounted on films GF connected to the display panel 110. As illustrated in FIG. 2, the gate driver ICs may be implemented as gate-in-panel (GIP) gate driver ICs, which are directly mounted on the display panel 110.

Hereinafter, the case in which the plurality of gate driver ICs in the gate driver circuit 130 are gate-in panel (GIP)-type gate driver ICs will be described for convenience of explanation; however, embodiments of the present disclosure are not limited thereto.

In addition, hereinafter, GIP-type gate driver ICs are described as panel-mounted gate driver chips GIP, i.e., gate driver chips disposed or mounted within the display panel 110.

The display device 100 according to some embodiments further includes at least one source printed circuit board (SPCB) providing circuit connections to the source driving ICs and a control printed circuit board (CPCB) on which control components and a variety of electrical devices are mounted.

In an embodiment, a plurality of circuit films SF on which the source driving ICs are mounted are connected to each SPCB, such that each SPCB is electrically connected to the display panel 110 via the plurality of circuit films SF.

The driving controller 140, a power controller (not shown in FIG. 2), or other components are mounted on the CPCB. The driving controller 140 controls the operations of the source driver circuit 120, the gate driver circuit 130, and the like. The power controller supplies a variety of voltages or currents to the display panel 110, the source driver circuit 120, or the gate driver circuit 130, and may also control the variety of voltages or currents to be supplied.

The circuit of the CPCB may be connected to the circuit of the SPCB via at least one connecting member.

In some embodiments, the connecting member may be a flexible printed circuit (FPC), a flexible flat cable (FFC), or the like.

The at least one SPCB and the CPCB may be integrated as a single PCB.

The driving controller 140 may be integrated with the source driving ICs.

Figure 3:
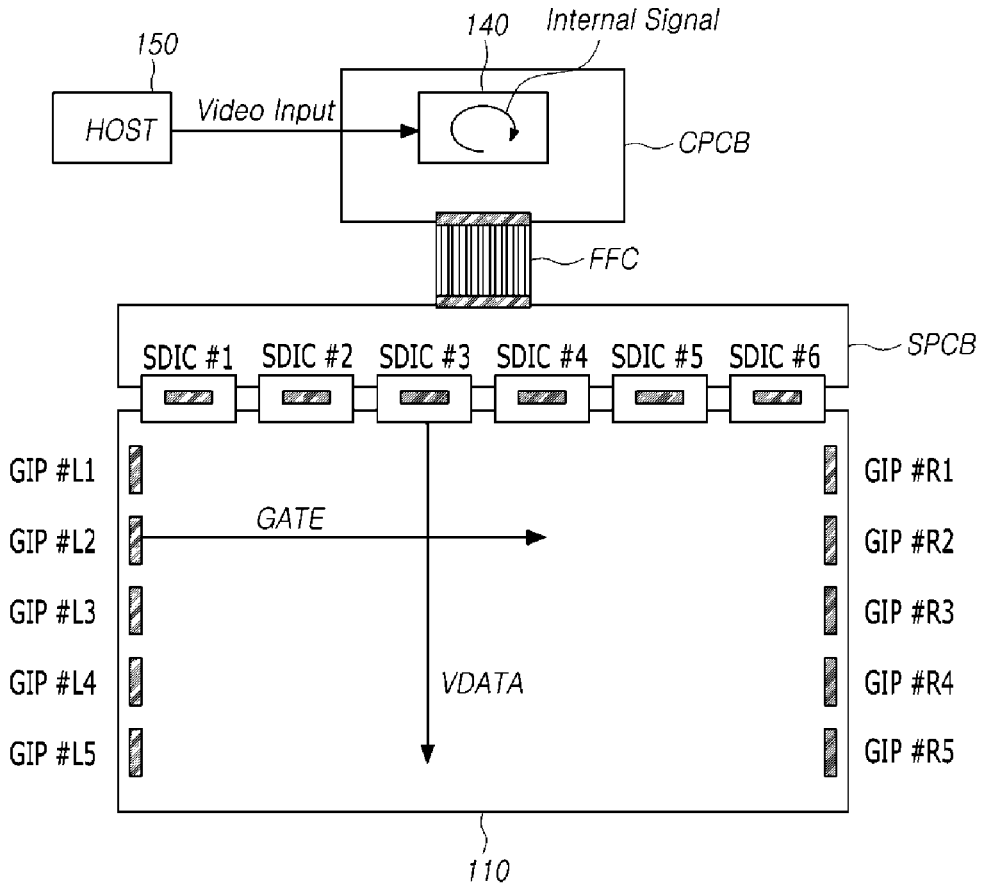
FIG. 3 illustrates driving-related functions and driving-related signals of a display device according to an embodiment.

FIG. 3 illustrates driving-related functions and driving-related signals of the display device 100 according to an embodiment.

As illustrated in FIG. 3, hereinafter, the display device 100 according to an embodiment will be described as including six source driving ICs SDIC #1, SDIC #2, SDIC #3, SDIC #4, SDIC #5, and SDIC #6.

In addition, the display device 100 according to an embodiment will be described as including ten panel-mounted gate driver chips GIP #L1, GIP #L2, GIP #L3, GIP #L4, GIP #L5, GIP #R1, GIP #R2, GIP #R3, GIP #R4, and GIP #R5. The term "panel-mounted" used herein refers to mounting within the display panel 110.

Among the ten panel-mounted gate driver chips GIP #L1 to GIP #L5 and GIP #R1 to GIP #R5, the five panel-mounted gate driver chips GIP #L1 to GIP #L5 will be described as being disposed on the left of the display panel 110, while the remaining five panel-mounted gate driver chips GIP #R1 to GIP #R5 will be described as being disposed on the right of the display panel 110.

Referring to FIG. 3, the display device 100 has a plurality of driving-related functions and a plurality of driving-related signals for display driving.

In some embodiments, there are four main factors influential in display driving and image quality of the display device 100. In other embodiments, factors different than those described below, or a different number of factors may influence the display driving and image quality.

In some embodiments, the four main factors are as follows.

One main factor involves a gate driving function of the panel-mounted gate driver chips GIP and a driving-related signal (e.g., a gate driving signal or a gate signal GATE) related to the gate driving function.

Another main factor involves a video input function and a driving-related signal related to the video input function, the driving-related signal being an input signal related to a video input supplied to the driving controller 140 from the host 150.

Another main factor involves an internal control function for driving control of the driving controller 140 and a driving-related signal related to the internal control function for driving control of the driving controller 140. The driving-related signal is an internal signal used within the driving controller 140 for controlling driving of the driving controller 140.

Another main factor involves a source driving function of the source driving ICs and a driving-related signal (e.g., a data driving control signal or a data voltage VDATA) related to the source driving function.

In some embodiments, when any one of the driving-related components (e.g., the host 150, the driving controller 140, the source driving ICs (SDICs), the panel-mounted gate driver chips (GIPs), the display panel 110, the SPCB, or the CPCB) malfunctions, an abnormality may occur in at least one of the aforementioned main factors.

As result of an abnormality, the display device 110 may not operate ordinarily, and the quality of images displayed may be degraded.

Thus, embodiments of the display device 110 monitor signals (e.g., four signals) to determine whether an abnormality has occurred for a given factor (e.g., one of the four main factors described above). Further, responsive to determining that a failure has occurred, depending on the result of the monitoring, the display device 110 may perform a fail-safe process.

The fail-safe process according to some embodiments is related to the four main factors described above and includes the following four fail-safe processes. In other embodiments, fail-safe processes different than those described below, or a different number of fail-safe processes may be performed by the display device 110.

One fail-safe process is a gate driving fail-safe process of inspecting a gate driving state of the panel-mounted gate driver chips GIP. Responsive to determining that a failure has occurred (e.g., based on the inspected gate driving state), the display device 110 normalizes the gate driving state.

Another fail-safe process is a video input fail-safe process (or an input signal fail-safe process) of inspecting a video input state. Responsive to determining that a failure has occurred (e.g., based on the inspected video input state), the display device 110 normalizes the video input.

Another fail-safe process is an internal logic fail-safe process (or an internal signal fail-safe process) of inspecting an internal control state for the driving control of the driving controller 140. Responsive to determining that a failure has occurred (e.g., based on the inspected internal control state), the display device 110 normalizes the internal logic of the driving controller 140.

Another fail-safe process is a source driving fail-safe process (or a lock signal fail-safe process) of inspecting the source driving state of the source driving ICs. Responsive to determining that a failure has occurred (e.g., based on the inspected source driving state), the display device 110 normalizes the source driving state.

The fail-safe process (or processes) may be performed by the driving controller 140, may be performed by a dedicated controller for the fail-safe process, or in some cases, may be performed by a controller different from the driving controller 140. Hereinafter, for the sake of brevity, the fail-safe process will be described as being performed by the driving controller 140.

Hereinafter, the driving controller 140 according to various embodiments and the various fail-safe processes performed thereby will be described in detail.

Figure 4:
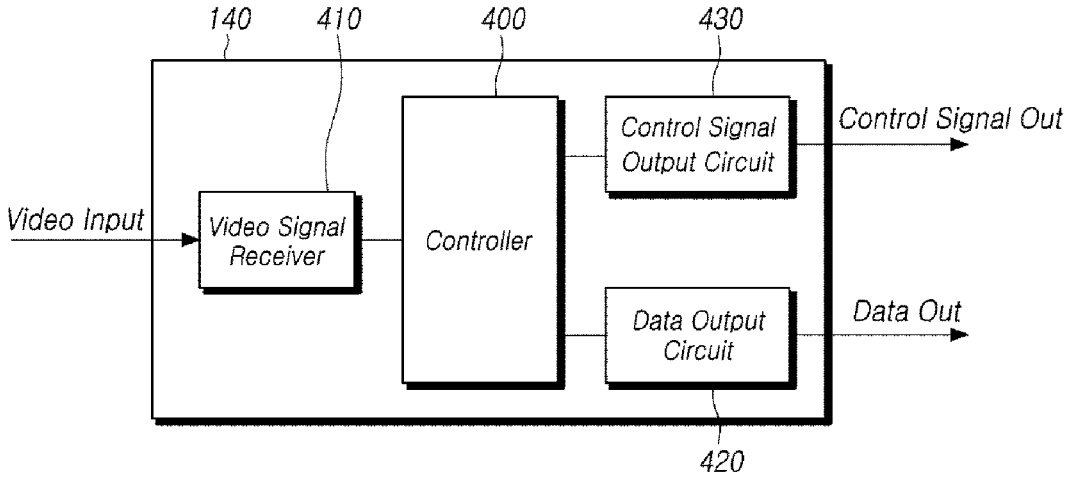
FIG. 4 is a block diagram of a driving controller of a display device according to an embodiment.

FIG. 4 is a block diagram of the driving controller 140 of the display device 100 according to an embodiment.

Referring to FIG. 4, the driving controller 140 of the display device 100 according to an embodiment includes a video signal receiver 410 receiving video signals, a data output circuit 420 outputting video data transformed (or converted) from the received video signals, a control signal output circuit 430 outputting control signals to control display driving, and a controller 400 corresponding to a control core. In other embodiments, the driving controller 140 may include different, fewer, or additional components not shown in FIG. 4.

The video signal receiver 410 receives video signals from the host 150.

The video signal receiver 410 may receive an input signal related to video input.

The input signal may include a DE signal, a vertical synchronization signal Vsync, a horizontal synchronization signal Hsync, a clock signal CLOCK, and the like, and may be regarded as including a video signal.

The data output circuit 420 converts a video signal input from an external source into a data signal format readable by the source driver circuit 120 and outputs image data converted in this manner.

The control signal output circuit 430 generates control signal, including a data driving control signal, a gate driving control signal, and the like, based on an input signal corresponding to a timing signal, such as a vertical synchronization signal Vsync, a DE signal, or a clock signal CLOCK. The control signal output circuit 430 outputs the control signal to the source driver circuit 120 and the gate driver circuit 130 in order to control the operation of the source driver circuit 120 and the gate driver circuit 130, respectively.

The controller 400, as a control core controlling the video signal receiver 410, the data output circuit 420, the control signal output circuit 430, and the like, may perform a fail-safe process.

The controller 400 may use any combination of the video signal receiver 410, the data output circuit 420, the control signal output circuit 430, or other components to perform the fail-safe process.

The aforementioned fail-safe process may include a monitoring process of monitoring signals (e.g., the four main signals described above) to determine whether a failure has occurred (e.g., in any one of four main factors described above) and a recovery process of, responsive to determining that a failure has occurred (e.g., in at least one factor among the four main factors), normalizing the failed main factor.

In response to the fail-safe process being performed as described above, an image displayed on the display panel 110 may be changed.

In this regard, after an abnormal screen image is displayed on the display panel 110, in response to reception of signals subjected to monitoring, the data output circuit 420 outputs data (e.g., black data) allowing a screen image (e.g., a recovery section image) different from the abnormal screen image to be displayed on the display panel 110.

Figure 5:
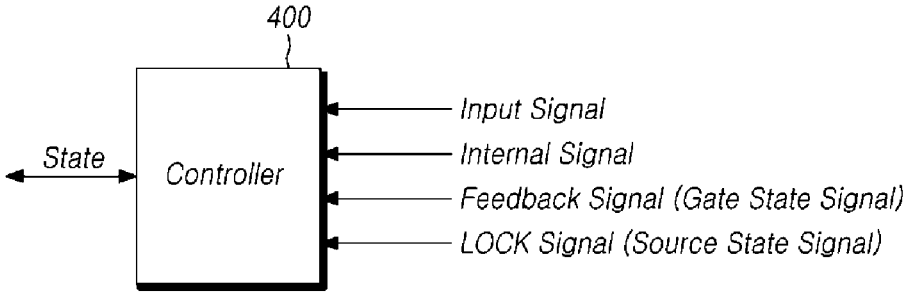
FIG. 5 illustrates monitoring signals monitored by the driving controller according to an embodiment.

FIG. 5 illustrates monitoring signals monitored by the driving controller 140 according to an embodiment.

Referring to FIG. 5, the controller 400 of the driving controller 140 according to an embodiment performs a monitoring process of monitoring main signals when performing the fail-safe process.

In an embodiment, to perform the gate driving fail-safe process, the controller 400 monitors a gate state signal indicative of a gate driving state in order to inspect the gate driving state of the panel-mounted gate driver chips GIP.

The aforementioned gate state signal may be one or a plurality of signals related to gate driving. As described herein, a feedback signal (e.g., a new signal) is suggested as the gate state signal. This will be described in more detail hereinafter.

In an embodiment, to perform the video input fail-safe process, the controller 400 monitors an input signal indicative of a video input state in order to inspect the video input state.

In an embodiment, to perform the internal logic fail-safe process, the controller 400 monitors an internal signal to inspect an internal control state for driving control of the driving controller 140, where the internal signal is used internally by the driving controller 140.

In an embodiment, to perform the source driving fail-safe process, the controller 400 monitors a source state signal indicative of a source driving state in order to inspect the source driving state of the source driving ICs.

The aforementioned source state signal may be a plurality of signals related to source driving. In other embodiments, the source state signal may be described as a lock signal, e.g., a new signal. This will be described in more detail hereinafter.

In some embodiments, during the monitoring of signals (e.g., a feedback signal, an input signal, an internal signal, or a lock signal as described above), responsive to determining that one of functions (e.g., a gate driving state, a video input state, an internal logic state, or a source driving state) corresponding to the monitored signals is abnormal, e.g., responsive to determining that a failure has occurred, the controller 400 records a current state in a recording medium, such as an internal or external register, as a fail-safe state in which a recovery process may be undertaken to normalize an abnormal function (e.g., corresponding to the abnormal signal).

The controller 400 may transmit information regarding the state, recorded in the recording medium as described above, to another device, such as the host 150, in the display device 100.

The other device, such as the host 150, in the display device 100 may read the information regarding the state recorded in the recording medium.

After the state is recognized by another device, such as the host 150, in the display device 100, a process specific to the recognized state may be performed.

Figure 6:
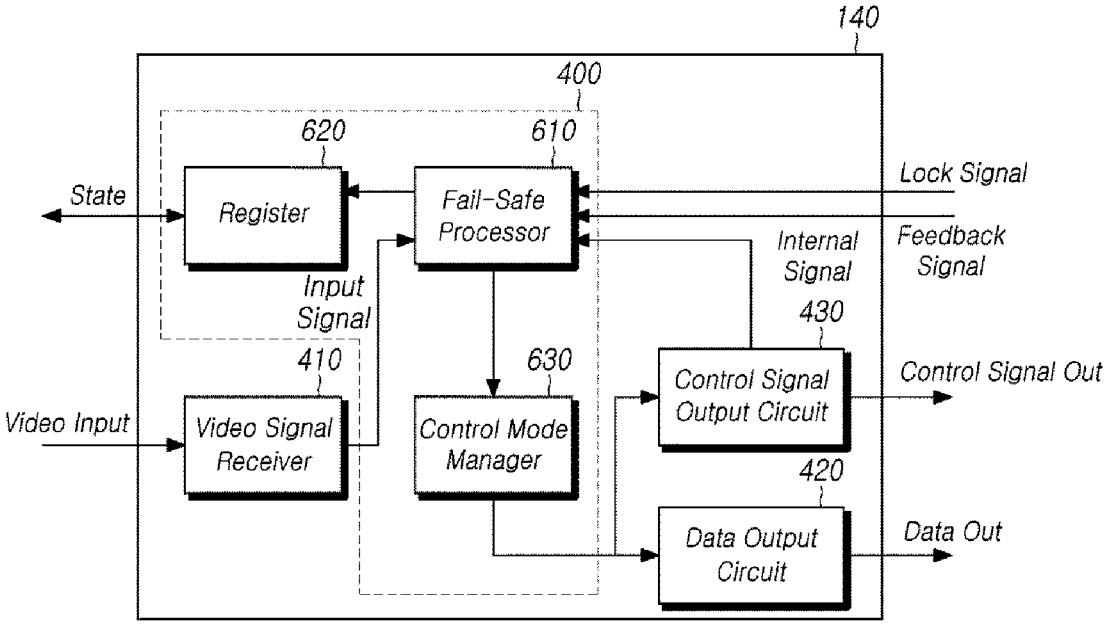
FIG. 6 is a block diagram of the driving controller according to an embodiment.

FIG. 6 is a block diagram of the driving controller 140 according to an embodiment.

Referring to FIG. 6, the controller 400 includes a fail-safe processor 610, a register 620, and a control mode manager 630.

In an embodiment, the fail-safe processor 610 is a main component used to perform the fail-safe process described above. The fail-safe processor 610 may perform a signal monitoring process, as described above with reference to FIG. 5, and a corresponding recovery process based on the monitoring process.

The fail-safe processor 610 may receive signals subjected to monitoring from inside or outside of the driving controller 140 to perform the signal monitoring process.

In relation to the performance of the gate driving fail-safe process, the fail-safe processor 610 may receive a gate state signal (e.g., a feedback signal), by which the gate driving state of the panel-mounted gate driver chips GIP is inspected.

A path along which the feedback signal may be input to the driving controller 140 will be described later.

In relation to the performance of the video input fail-safe process, the fail-safe processor 610 may receive a video input-related input signal, by which the video input state is inspected, through the video signal receiver 410.

In relation to the performance of the internal logic fail-safe process, the fail-safe processor 610 may receive an internal signal, by which an internal control state for the driving control of the driving controller 140 is inspected, from the control signal output circuit 430.

In relation to the performance of the fail-safe process, the fail-safe processor 610 may receive a source state signal (e.g., a lock signal), by which the source driving state of source driving ICs is inspected.

As the result of the performance of the signal monitoring process, responsive to determining that a problem (e.g., a failure) has occurred, the fail-safe processor 610 may change the current state stored in the register 620 to a fail-safe state.

Information regarding the current state stored in the register 620 may be recognized by another device, such as the host 150, or may be transmitted to the other device, such as the host 150.

In response to the fail-safe processor 610 performing the fail-safe process, the control mode manager 630 may change the control mode.

Responsive to the control mode being changed by the control mode manager 630, the data output circuit 420 may stop or control data output, depending on the changed control mode.

In addition, responsive to the control mode being changed by the control mode manager 630, the control signal output circuit 430 may control whether a control signal is output or control the characteristics of the control signal, depending on the changed control mode.

Hereinafter, various fail-safe processes will be described in more detail.

The gate driving fail-safe process will be described with reference to FIGS. 7 to 14, the video input fail-safe process will be described with reference to FIGS. 15 and 16, the internal logic fail-safe process will be described with reference to FIG. 17, and the source driving fail-safe process will be described with reference to FIGS. 18 and 19, according to various embodiments.

Figure 7:
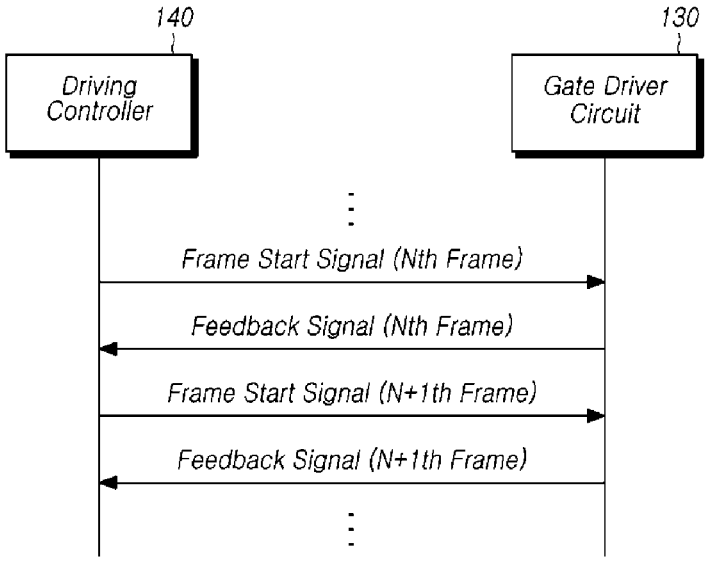
FIGS. 7, 8, and 9 are sequence diagrams illustrating a gate driving fail-safe process according to various embodiments.
Figure 8:
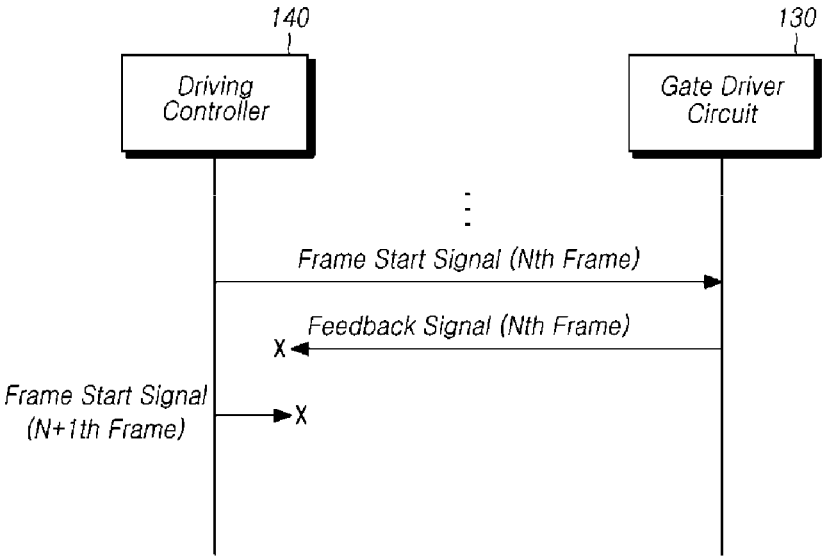
Figure 9:
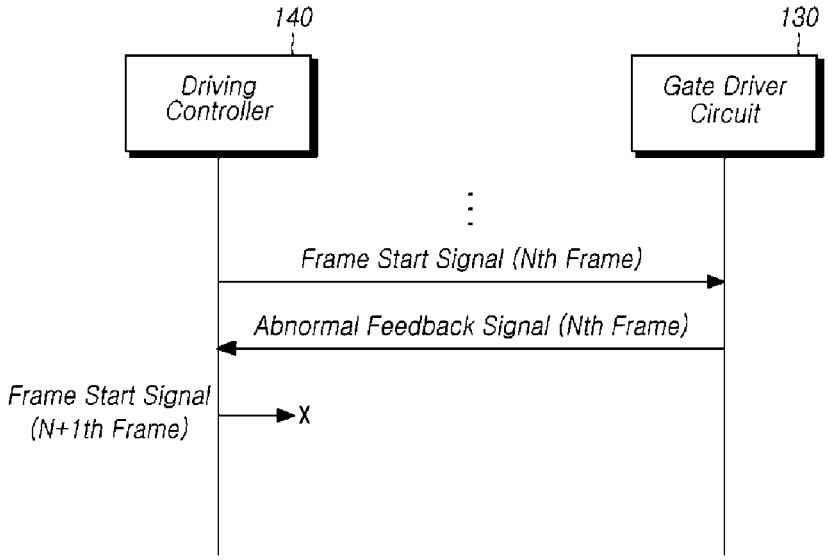

FIGS. 7, 8, and 9 are sequence diagrams illustrating a gate driving fail-safe process according to various embodiments.

Referring to FIGS. 7 to 9, the driving controller 140 may output a frame start signal (FSS) in every frame, determine whether a gate driving state is normal or abnormal by checking whether a feedback signal (FBS) has been received, or by checking the state of the feedback signal (e.g., when the feedback signal has been received), before the next frame starts, and controls whether to normally start the next frame or to not start the next frame (e.g., and instead perform a recovery process), depending on the result of the determination.

In an embodiment, the frame start signal is transmitted by the driving controller 140 to the gate driver circuit 130 at, prior, or directly prior to a point in time at which the corresponding frame starts.

The feedback signal may be transmitted by the gate driver circuit 130 to the driving controller 140 during a frame blank section within the corresponding frame section. For example, the feedback signal may be transmitted at a point in time at which the frame blank section starts.

Responsive to determining that the gate driving state is normal, the driving controller 140 may output a frame start signal for the next frame, so that the next frame starts normally.

Responsive to determining that the gate driving state is abnormal, the driving controller 140 may perform a recovery process without outputting a frame start signal for the next frame so that the next frame does not start.

The gate driving fail-safe process that has been described briefly will be further described with reference to FIGS. 7 to 9.

FIG. 7 illustrates signal flows in an example case in which a gate driving fail-safe process is performed in a normal gate driving state, while FIGS. 8 and 9 illustrate signal flows in example cases in which the gate driving fail-safe process is performed in an abnormal gate driving state.

Referring to FIGS. 7 to 9, the control signal output circuit 430 of the driving controller 140 outputs a frame start signal (FSS) for an $N^{th}$ frame so that the $N^{th}$ frame is driven (e.g., started), where N is (e.g., an integer) greater than or equal to one ($N \geq 1$).

After the frame start signal for the $N^{th}$ frame is output, the controller 400 of the driving controller 140 may receive a feedback signal (FBS) in a frame blank section.

After the frame start signal for the $N^{th}$ frame is output, the controller 400 of the driving controller 140 may determine whether to output a frame start signal for an (N+1)th frame (the next frame), depending on the state or reception of the feedback signal.

In an embodiment, after the frame start signal for the $N^{th}$ frame is output, the controller 400 of the driving controller 140 checks whether the feedback signal has been received or checks the state of the received feedback signal.

Referring to FIG. 7, after the frame start signal for the $N^{th}$ frame is output, when the feedback signal has been received during the frame blank section, the controller 400 determines that the received feedback signal includes normal pulses corresponding to a first state, e.g., based on a predetermined reference signal. Thus, as the result of checking whether the feedback signal has been received or checking the state of the feedback signal, the controller 400 of the driving controller 140 may determine that a current gate driving state is a normal gate state.

Consequently, the driving controller 140 may output the frame start signal for the (N+1)th frame to the gate driver circuit 130, such that the next frame starts normally In some embodiments, instead of consecutive frames, the Nth frame and (N+1)th frames may be first and second frames, respectively, that are not necessarily consecutive.

Referring to FIG. 8, after the frame start signal for the (N+1)th frame is output, the driving controller 140 determines that the feedback signal has not been received until a point in time at which the section of the (N+1)th frame expires (i.e., a point in time at which the frame blank section expires). Thus, as the result of checking whether the feedback signal has been received or checking the state of the feedback signal, the driving controller 140 may determine that the current gate driving state is an abnormal gate driving state.

Consequently, the driving controller 140 may determine to not output the frame start signal for the (N+1)th frame to the gate driver circuit 130, such that the next frame does not start normally.

Referring to FIG. 9, after the frame start signal for the (N+1)th frame is output, the driving controller 140 determines the feedback signal is an abnormal feedback signal corresponding to a second state, e.g., based on a predetermined reference signal. Thus, as the result of checking whether or not the feedback signal has been received or checking the state of the feedback signal, the driving controller 140 may determine that the current gate driving state is an abnormal gate driving state.

Consequently, the driving controller 140 may determine to not output the frame start signal for the (N+1)th frame to the gate driver circuit 130, such that the next frame does not start normally.

As illustrated in FIGS. 8 and 9, when the frame start signal for the (N+1)th frame is not output due to the determination of the abnormal gate driving state, the driving controller 140 may proceed with a recovery process to recover the abnormal gate driving state to a normal gate driving state. In some embodiments, instead of consecutive frames, the Nth frame and (N+1)th frames may be first and second frames, respectively, that are not necessarily consecutive. Thus, the driving controller 140 may wait a certain period of time (e.g., a given number of frames) before proceeding with the recovery process.

The driving controller 140 may perform the recovery process by controlling the data output circuit 420, the control signal output circuit 430, or the control mode manager 630.

As described above, the driving controller 140 determines whether the gate driving state in the current frame section is an abnormal gate driving state or a normal gate state. Responsive to determining that the gate driving state is the abnormal gate driving state, the driving controller 140 may prevent abnormal gate driving from occurring in the next frame. This can consequently prevent abnormal screen images from being displayed by the display panel 110 that would otherwise be caused by abnormal gate driving.

In an embodiment, a high level voltage of the feedback signal received by the driving controller 140 may be lower than a high level gate voltage of a gate-related signal, such as a gate signal GATE, transferred to the gate lines GL.

For example, the high level voltage of the feedback signal may range from 2V to 5V, while the high level gate voltage of the gate signal transferred to the gate lines GL may range from 10V to 18V.

In an embodiment, the high level voltage of the feedback signal may be a voltage within an operable voltage range of the driving controller 140, while the high level gate voltage of the gate-related signal, such as a gate signal, may be a voltage within an operable voltage range of the gate driver circuit 130.

The use of the feedback signal having the above-described voltage characteristics allows the driving controller 140 and the gate driver circuit 130 to operate normally. In addition, the driving controller 140 may correctly determine whether the gate driving state is normal or abnormal by accurately detecting the feedback signal.

Figure 10:
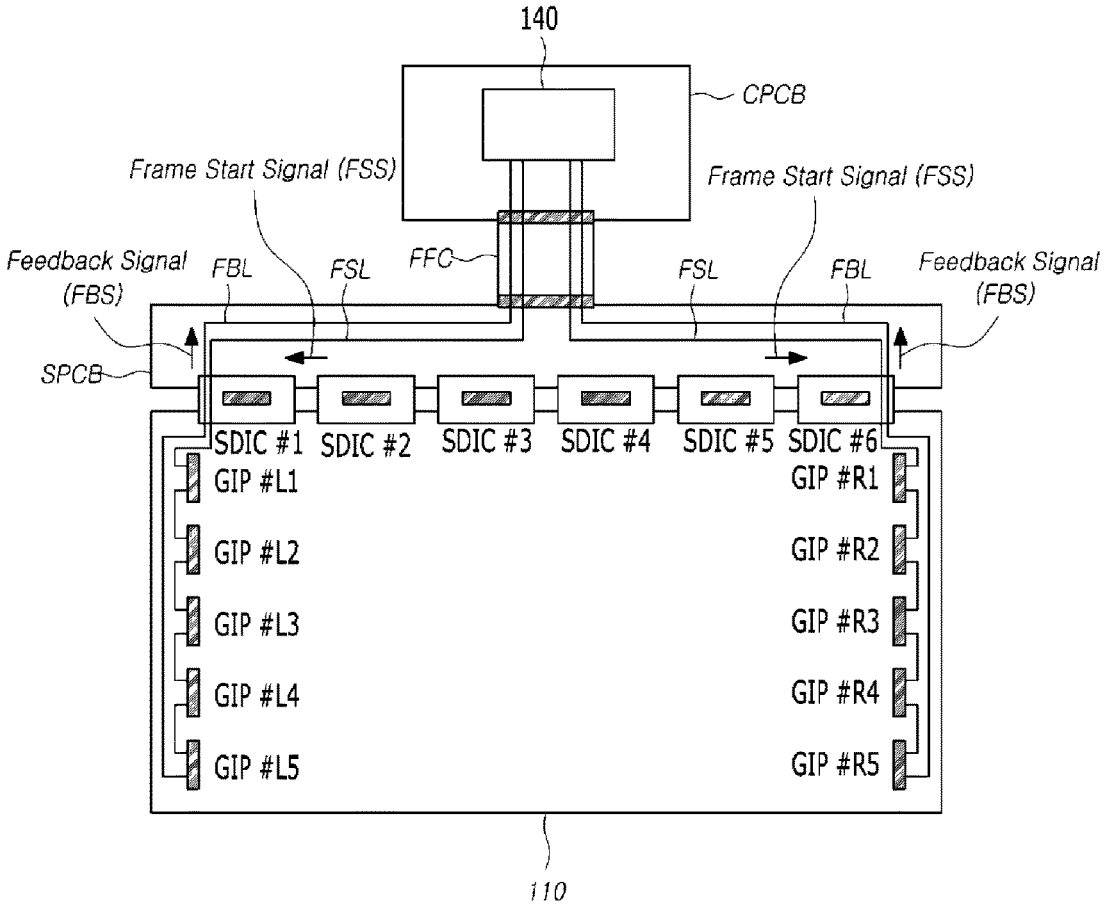
FIG. 10 illustrates signal lines for the gate driving fail-safe process according to an embodiment.

FIG. 10 illustrates signal lines FBL and FSS for the gate driving fail-safe process according to an embodiment.

Referring to FIG. 10, the display device 100 according to an embodiment includes frame start signal lines FSL, through which a frame start signal FSS is delivered, and feedback signal lines FBL, through which feedback signals are delivered, to perform the gate driving fail-safe process.

The frame start signal lines FSL are signal lines electrically connecting the driving controller 140 and the gate driver circuit 130. The frame start signal lines FSL may be complex signal lines in which a plurality of signal lines are connected, and the frame start signal lines FSL may be single integrated signal lines.

The frame start signal lines FSL may be disposed on any path between the driving controller 140 and the gate driver circuit 130.

The feedback signal lines FBL are signal lines electrically connecting the gate driver circuit 130 and the driving controller 140. The feedback signal lines FBL may be complex signal lines in which a plurality of signal lines are connected, and the feedback signal lines FBL may be single integrated signal lines.

The feedback signal lines FBL may be disposed on any path between the gate driver circuit 130 and the driving controller 140.

Since the frame start signal lines FSL and the feedback signal lines FBL, as described above, are provided, signal monitoring is enabled, thereby enabling the gate driving fail-safe process to be performed.

Hereinafter, an arrangement structure of the frame start signal lines FSL and the feedback signal lines FBL in the embodiments illustrated in FIGS. 2 and 3, as well as a method of delivering a frame start signal FSS and a method of delivering feedback signals FBS using this arrangement structure, will be described with reference to FIG. 10.

The frame start signal lines FSL and the feedback signal lines FBL may be arranged to extend through the display panel 110, the circuit films FS, the source PCB (SPCB), and the control PCB (CPCB).

The frame start signal lines FSL may include first frame start signal lines and second frame start signal lines. In an embodiment, the first frame start signal lines electrically connect the driving controller 140 and the first panel-mounted gate driver chips GIP #L1 and GIP #R1, while the second frame start signal lines are connected, e.g., in cascade form, to the first to last panel-mounted gate driver chips GIP #L1 to GIP #L5 and GIP #R1 to GIP #R5.

The first frame start signal lines of the frame start signal lines FSL may be arranged along the display panel 110, the circuit films SF, the SPCB, and the CPCB.

The second frame start signal lines of the frame start signal lines FSL may be arranged on the display panel 110.

The feedback signal lines FBL electrically connect the driving controller 140 and the last panel-mounted gate driver chips GIP #L5 and GIP #R5 in the embodiment shown in FIG. 10.

The feedback signal lines FBL may be arranged along the display panel 110, the circuit films SF, the SPCB, and the CPCB, present between the driving controller 140 and the last panel-mounted gate driver chips GIP #L5 and GIP #R5.

Each or some of the feedback signal lines FBL may be an assembly in which a plurality of segments of the signal line are connected.

As described above, even in embodiments in which a plurality of components are present between the driving controller 140 and the gate driver circuit 130, feedback signals FBS may be properly delivered to the driving controller 140.

As illustrated in the embodiment shown in FIG. 10, the gate driver circuit 130 includes the plurality of panel-mounted gate driver chips GIP #L1 to GIP #L5 and GIP #R1 to GIP #R5.

In an embodiment, a frame start signal FSS for the $N^{th}$ frame is output from the driving controller 140 to the first panel-mounted gate driver chips GIP #L1 and GIP #R1, among the plurality of panel-mounted gate driver chips GIP #L1 to GIP #L5 and GIP #R1 to GIP #R5.

In an embodiment, feedback signals FBS are transmitted by the last panel-mounted gate driver chips GIP #L5 and GIP #R5, among the plurality of panel-mounted gate driver chips GIP #L1 to GIP #L5 and GIP #R1 to GIP #R5, to the driving controller 140.

In the embodiment shown in FIG. 10, the feedback signals FBS are transmitted from the bottom points of display panel 110 (i.e., the farthest downstream points opposite to points at which a frame start signal FSS is transferred) to the driving controller 140, so that the driving controller 140 can monitor the gate driving state over the entire area of the display panel 110.

Referring to FIG. 10, the frame start signal FSS for the $N^{th}$ frame is output from the driving controller 140 to the first panel-mounted gate driver chips GIP #L1 and GIP #R1 among the plurality of panel-mounted gate driver chips GIP #L1 to GIP #L5 and GIP #R1 to GIP #R5.

Subsequently, the frame start signal FSS for the $N^{th}$ frame may be delivered in cascade form from the first panel-mounted gate driver chips GIP #L1 and GIP #R1 to the last panel-mounted gate driver chip GIP #L5 and GIP #R5, respectively.

For example, in the left area, the frame start signal FSS for the $N^{th}$ frame is sequentially delivered from GIP #L1 to GIP #L2, from GIP #L2 to GIP #L3, from GIP #L3 to GIP #L4, and from GIP #L4 to GIP #L5.

In addition, in the right area, the frame start signal FSS for the $N^{th}$ frame is sequentially delivered from GIP #R1 to GIP #R2, from GIP #R2 to GIP #R3, from GIP #R3 to GIP #R4, and from GIP #R4 to GIP #R5.

The last panel-mounted gate driver chips GIP #L5 and GIP #R5 may output the frame start signal FSS for the $N^{th}$ frame, delivered thereto, as the feedback signals to the driving controller 140.

As described above, in an embodiment in which the frame start signal FSS is delivered from the top points (i.e., the points to which the frame start signal FSS is transferred) to the bottom points (i.e., the farthest downstream points opposite to the top points to which a frame start signal FSS is transferred) of a display panel 110, the frame start signal FSS reflects the gate driving state over the entire area of the display panel 110. Thus, the frame start signal FSS reflecting the gate driving state over the entire area of the display panel 110 is fed back, as the feedback signals FBL, to the driving controller 140, so that the driving controller 140 can monitor the gate driving state over the entire area of the display panel 110.

Figure 11:
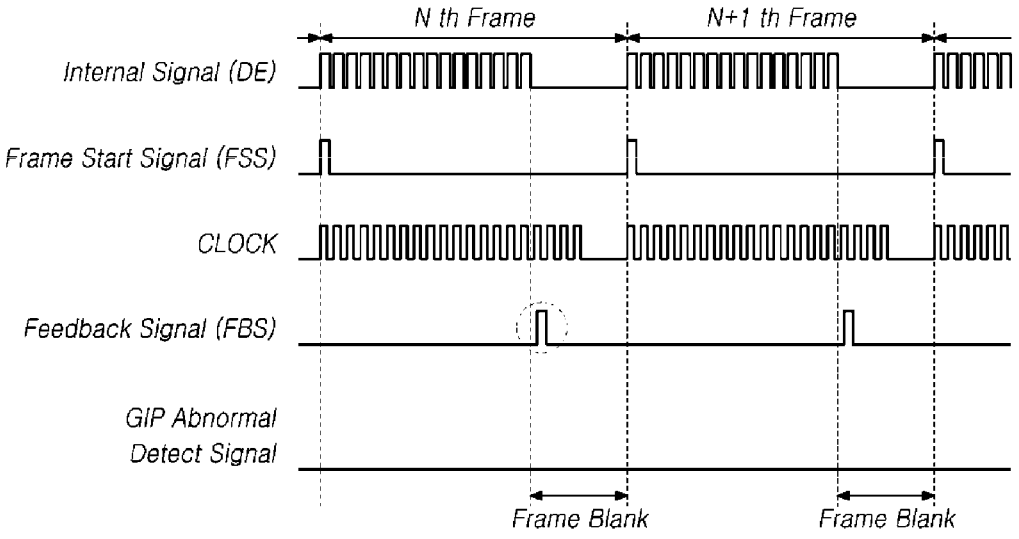
FIG. 11 is a driving timing diagram illustrating a normal gate driving state of the gate driving fail-safe process according to an embodiment.
Figure 12:
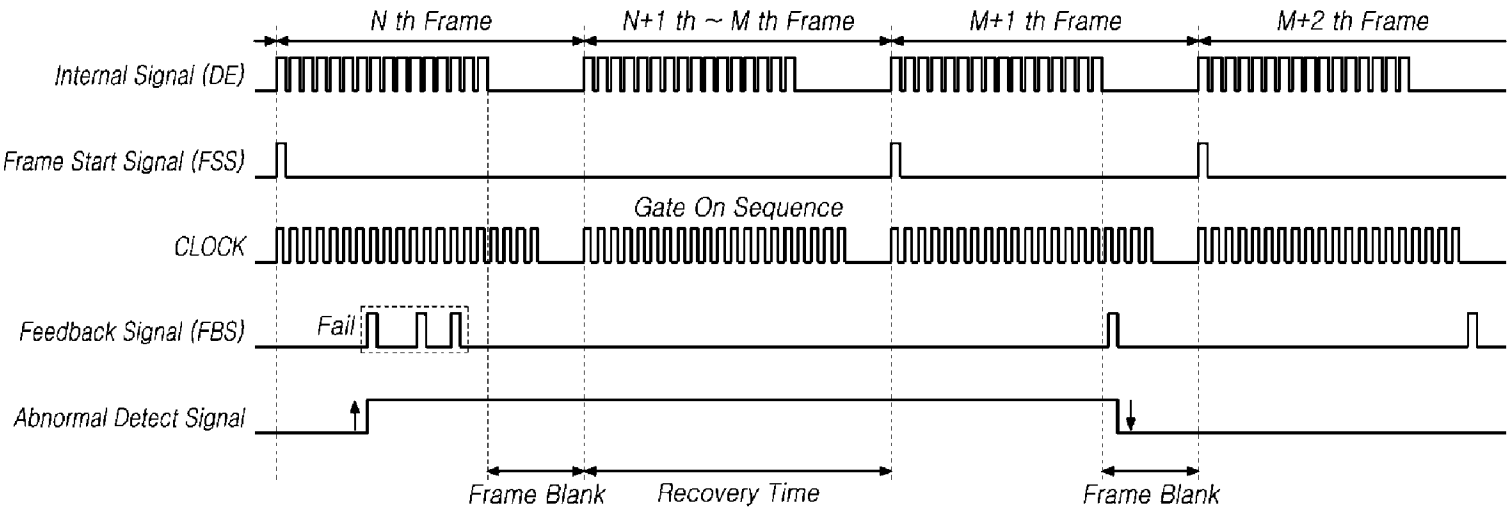
FIG. 12 is a driving timing diagram illustrating an abnormal gate driving state of the gate driving fail-safe process according to an embodiment.

FIG. 11 is a driving timing diagram illustrating a normal gate driving state of the gate driving fail-safe process according to an embodiment, while FIG. 12 is a driving timing diagram illustrating an abnormal gate driving state of the gate driving fail-safe process according to an embodiment.

A frame start signal FSS may be comprised of K number of pulses, where K is (e.g., an integer) greater than or equal to one ($K \geq 1$).

The frame start signal FSS, e.g., including the K number of pulses, is a portion indicating a frame start point. The frame start signal FSS may have a high level voltage and a low level voltage.

In the embodiments shown in FIGS. 11 and 12, the frame start signal FSS is comprised of one pulse ($K=1$).

In addition, in the embodiments shown in FIGS. 11 and 12, the frame start signal FSS is a single pulse that increases from a low level voltage to a high level voltage.

In some embodiments, a normal feedback signal FBS may include K number of pulses ($K \geq 1$).

The number of pulses of a normal feedback signal FBS may be the same as the number of pulses of the frame start signal FSS corresponding thereto.

The number of pulses of an abnormal feedback signal FBS may be less than K, or equal to or greater than K+1.

Even in some cases in which the feedback signal FBS is comprised of K number of pulses ($K \geq 1$), the driving controller 140 may determine that the feedback signal FBS is an abnormal feedback signal.

For example, the driving controller 140 may determine that the feedback signal FBS is an abnormal feedback signal responsive to determining that at least one of the amplitude, voltage, pulse width, or another characteristic thereof is abnormal, based on predetermined references, for example, a threshold (or threshold difference of) amplitude or voltage, or a threshold pulse width. For instance, the driving controller 140 may determine that the feedback signal FBS is an abnormal feedback signal responsive to determining that a difference between the amplitude of the frame start signal FSS and the feedback signal FBS is greater than the threshold difference of amplitude.

Referring to FIG. 11, after the frame start signal FSS for the $N^{th}$ frame is output, responsive to determining that the received feedback signal FBS is K number of pulses (e.g., one pulse as shown in FIG. 11), the amplitude or voltage of the received feedback signal FBS is within a predetermined normal amplitude or voltage range, or the pulse width of the received feedback signal FBS is within a predetermined normal pulse width range, the driving controller 140 may determine that the feedback signals FBS represent normal pulses corresponding to a first state.

Based on the determination that the feedback signals FBS represent normal pulses, the driving controller 140 may output a frame start signal FSS for an (N+1)th frame.

Accordingly, the gate driving for display driving is continued.

In contrast, after the frame start signal FSS for the $N^{th}$ frame is output, responsive to determining that the feedback signal FBS has not been received, the received feedback signal FBS includes a number of pulses that is smaller than K or equal to or greater than K+1, the amplitude or voltage of the received feedback signal FBS is not within the predetermined normal amplitude or voltage range, or the pulse width of the received feedback signal FBS is not within the predetermined normal pulse width range, the driving controller 140 may determine that the feedback signal FBS represents abnormal pulses, corresponding to a second state.

Responsive to determining that the feedback signal FSS represents abnormal pulses, as described above, the fail-safe processor 610 in the controller 400 of the driving controller 140 may change the signal level of an abnormality detection signal (e.g., GIP Abnormal Detect Signal as shown in FIG.

11) to a level indicating an abnormal state (e.g., a high level). A low level of the abnormality detection signal may indicate a normal state.

In an embodiment, the control mode manager 630 in the controller 400 changes the control mode to a fail-safe-related control mode responsive to determining that the abnormality detection signal indicates the abnormal state.

Thus, the control signal output circuit 430 of the driving controller 140 does not output a frame start signal FSS for an (N+1)th frame.

Accordingly, the gate driving for display driving is not continued. That is, abnormal gate driving can be prevented.

It is therefore possible to check abnormal feedback signals FBS based on whether the feedback signals FBS are received or considering a variety of signal characteristics of the feedback signals FBS, thereby more correctly and precisely determining the abnormal gate driving state.

After the gate driving state is determined to be abnormal, as described above, the driving controller 140 may perform a recovery process to normalize the abnormal gate driving state to the normal gate driving state.

The recovery process is performed as follows, according to an embodiment.

Referring to FIG. 12, responsive to determining that the gate driving state is abnormal since the feedback signals FBS are not received or the feedback signals FBS are determined to be abnormal pulses depending on predetermined references, the driving controller 140 does not output the frame start signal FSS for the (N+1)th frame and performs a gate driving recovery process to output a clock signal CLOCK during a period of recovery time, corresponding to a period of time of at least one frame among the (N+1)th frame to an $M^{th}$ frame (W≥2).

In an embodiment, the gate driving recovery process is referred to as a gate-on sequence in which, after power-on, only the clock signal CLOCK may be transferred to the gate driver circuit 130 during the period of time of the at least one frame.

After performing the gate driving recovery process (e.g., a process of only outputting the clock signal) during the recovery period corresponding to the period of time of the at least one frame, the driving controller 140 outputs a frame start signal FSS for an (M+1)th frame to recognize whether or not the gate driving state is recovered to a normal gate driving state.

As illustrated in FIG. 12, responsive to determining that feedback signals FBS are received normally at a point in time at which a frame blank section starts, the driving controller 140 determines that the abnormal gate driving state is recovered to the normal gate driving state and outputs a frame start signal FSS for an (M+2)th frame.

Consequently, the gate driving is resumed.

On the other hand, responsive to determining that no feedback signals FBS are received or an abnormal feedback signal FBS is received during the frame blank section, the driving controller 140 determines that the abnormal gate driving state is not recovered normally and re-performs the gate driving recovery process.

Due to the gate driving recovery process, the abnormal gate driving state may be recovered to the normal gate driving state.

Figure 13:
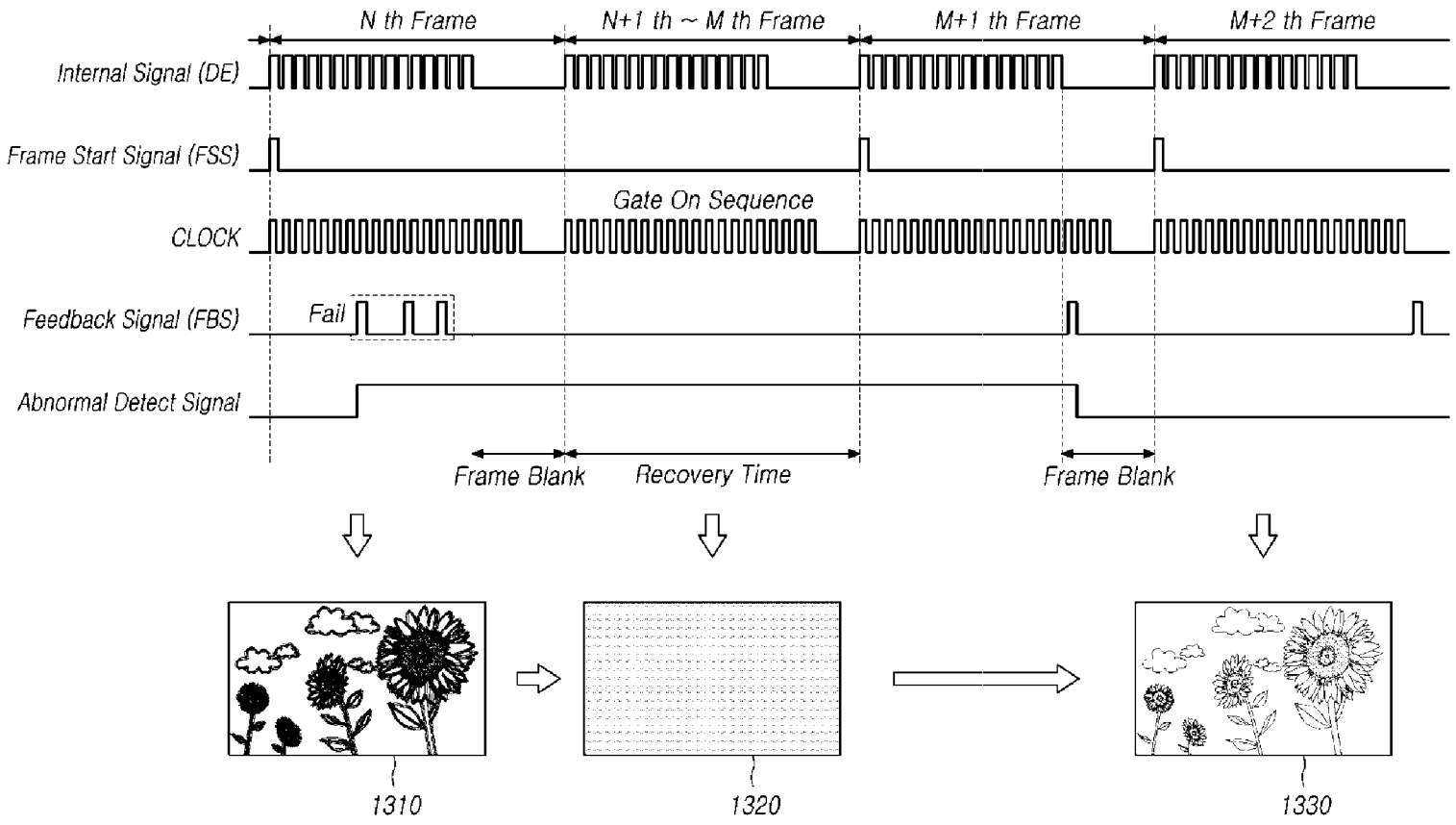
FIG. 13 illustrates a change in screen images before and after the gate driving fail-safe process according to an embodiment.

FIG. 13 illustrates a change in screen images before and after the gate driving fail-safe process according to an embodiment.

Referring to FIG. 13, in an abnormal gate driving state, an abnormal screen image 1310 is displayed on the display panel 110.

Responsive to detecting a failure corresponding to the abnormal gate driving state causing the abnormal screen image 1310, the driving controller 140 performs a gate driving recovery process.

In response to the gate driving recovery process being performed, while a frame start signal FSS for an (N+1)th frame is not being output to the gate driver circuit 130, i.e., for a predetermined period of time from a point in time at which the frame start signal FSS for an (N+1)th frame is not output, a gate driving recovery section image 1320 may be displayed on the display panel 110.

The gate driving recovery section image 1320 may be a screen image different from either the abnormal screen image 1310 or a normal screen image (i.e., a typical frame image).

For example, the gate driving recovery section image 1320 may be a completely black screen image or a black screen image having a low grayscale of a predetermined level or lower.

As described above, during the recovery period in which the gate driving recovery process is performed, the gate driving recovery section image 1320 may be displayed on the display panel 110. Consequently, the abnormal screen image 1310 is not displayed any further, and the user can recognize that the display device is being recovered from the display-related problem.

Figure 14:
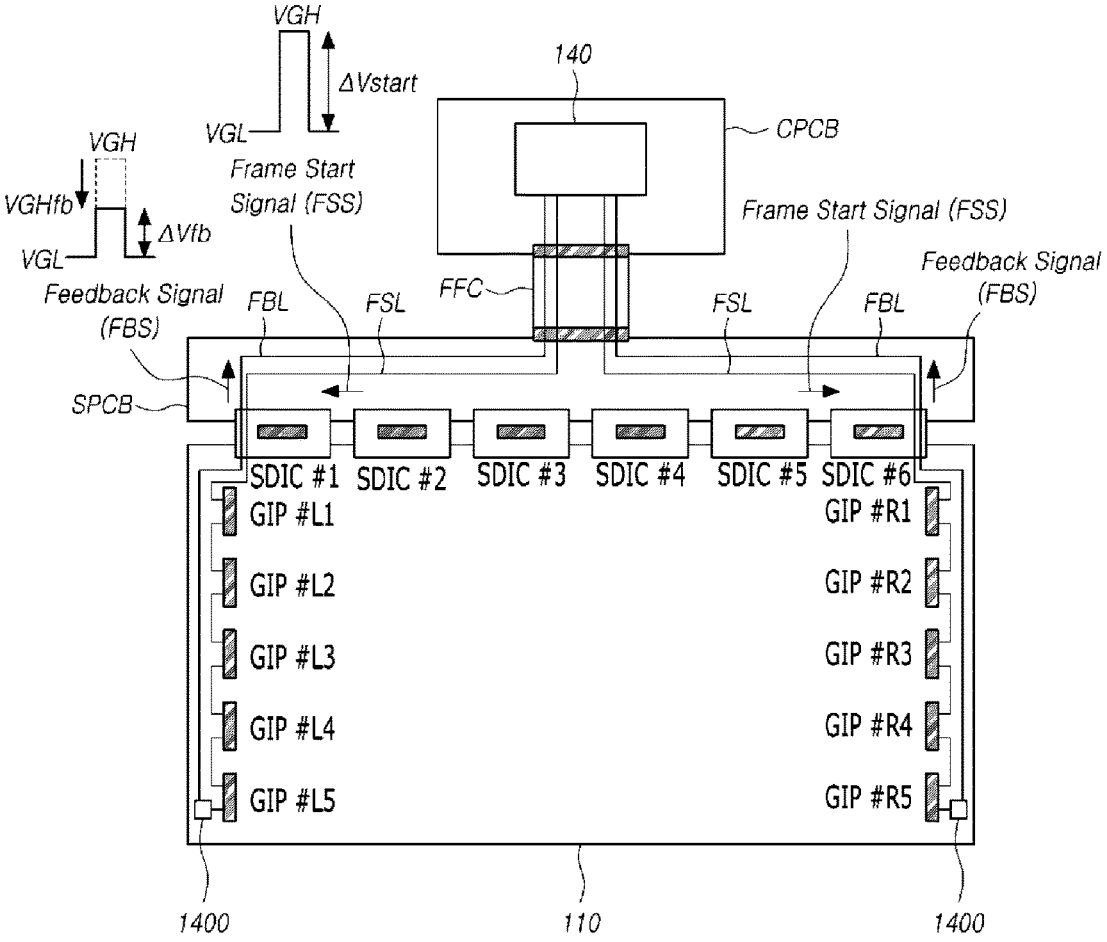
FIG. 14 illustrates a process of adjusting a voltage of a feedback signal in the gate driving fail-safe process according to an embodiment.

FIG. 14 illustrates a process of adjusting a voltage of a feedback signal FBS in the gate driving fail-safe process according to an embodiment.

Referring to FIG. 14, an operable voltage range and detectable signal characteristics (e.g., a high level voltage, a low level voltage, or an amplitude) of the driving controller 140 may differ from another operable voltage range and detectable signal characteristics (e.g., a high level voltage, a low level voltage, or an amplitude) of the panel-mounted gate driver chips GIP #L1 to GIP #L5 and GIP #R1 to GIP #R5.

As shown in FIG. 14, a high level voltage and a low level voltage of a frame start signal FSS output from the driving controller 140 are indicated with VGH and VGL, respectively, and the amplitude of the frame start signal FSS is indicated with ΔVstart. In some embodiments, the high level voltage VGH, the low level voltage VGL, and the amplitude ΔVstart of the frame start signal FSS must satisfy the operable voltage range and the detectable signal characteristics (e.g., the high level voltage, the low level voltage, or the amplitude) of the panel-mounted gate driver chips GIP #L1 to GIP #L5 and GIP #R1 to GIP #R5.

The driving controller 140 may operate and detect signals in a voltage range lower than the high level voltage VGH of the frame start signal FSS.

In this regard, the display device 100 according to some embodiments further includes one or more signal adjusters 1400 to adjust the voltage or amplitude of feedback signals FBS, transmitted to the driving controller 140, to a desired voltage VGHfb or a desired amplitude ΔVfb, in consideration of the operable voltage range and the detectable signal characteristics (e.g., the high level voltage, the low level voltage, or the amplitude) of the driving controller 140.

In an embodiment, the high level voltage VGHfb of the feedback signals FBS received by the driving controller 140 may be lower than a high level gate voltage VGH of a gate-related signal, such as a gate signal GATE, supplied to the gate lines GL.

The high level voltage VGHfb of the feedback signals FBS received by the driving controller 140 may be lower than a high level voltage VGH of the frame start signal FSS corresponding to the gate-related signal.

For example, when the high level gate voltage VGH of the gate signal GATE supplied to the gate lines GL or the high level voltage VGH of the frame start signal FSS that the gate driver circuit 130 receives is in the range of 10V to 16V, the high level voltage of the feedback signals FBS that the driving controller 140 receives may be in the range of 2V to 5V.

In addition, the amplitude ΔVfb=VGHfb−VGL of the feedback signals FBS that the controller 140 receives may be less than a difference between the high level gate voltage and the low level voltage (e.g., ΔVfb=VGH−VGL) of the gate-related signal, such as the gate signal GATE, transferred to the gate lines GL.

The amplitude ΔVfb=VGHfb−VGL of the feedback signals FBS that the controller 140 receives may be less than the high level voltage (e.g., ΔVstart=VGH−VGL) of the frame start signal FSS corresponding to the gate-related signal.

The use of the feedback signals FBS having the above-described voltage characteristics allows the driving controller 140 and the gate driver circuit 130 to operate normally. In addition, the driving controller 140 may correctly determine whether or not the gate driving state is normal by accurately detecting the feedback signals FBS.

In addition, the use of the feedback signals FBS having the above-described amplitude and voltage characteristics allows the driving controller 140 and the gate driver circuit 130 to operate normally. In addition, the driving controller 140 may correctly determine whether the gate driving state is normal by accurately detecting the feedback signals FBS.

Figure 15:
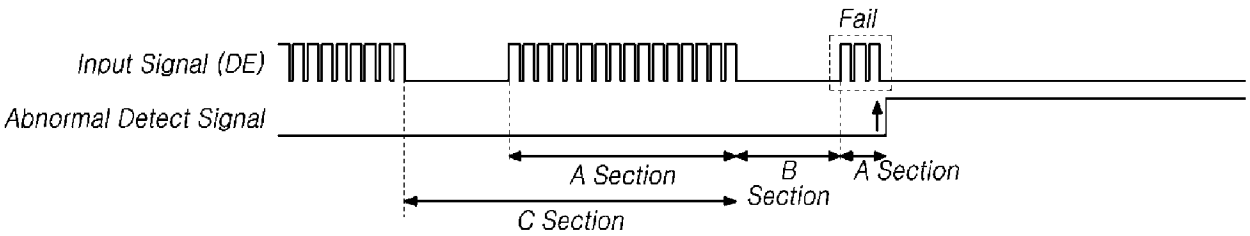
FIG. 15 is a driving timing diagram related to a video input fail-safe process according to an embodiment.
Figure 16:
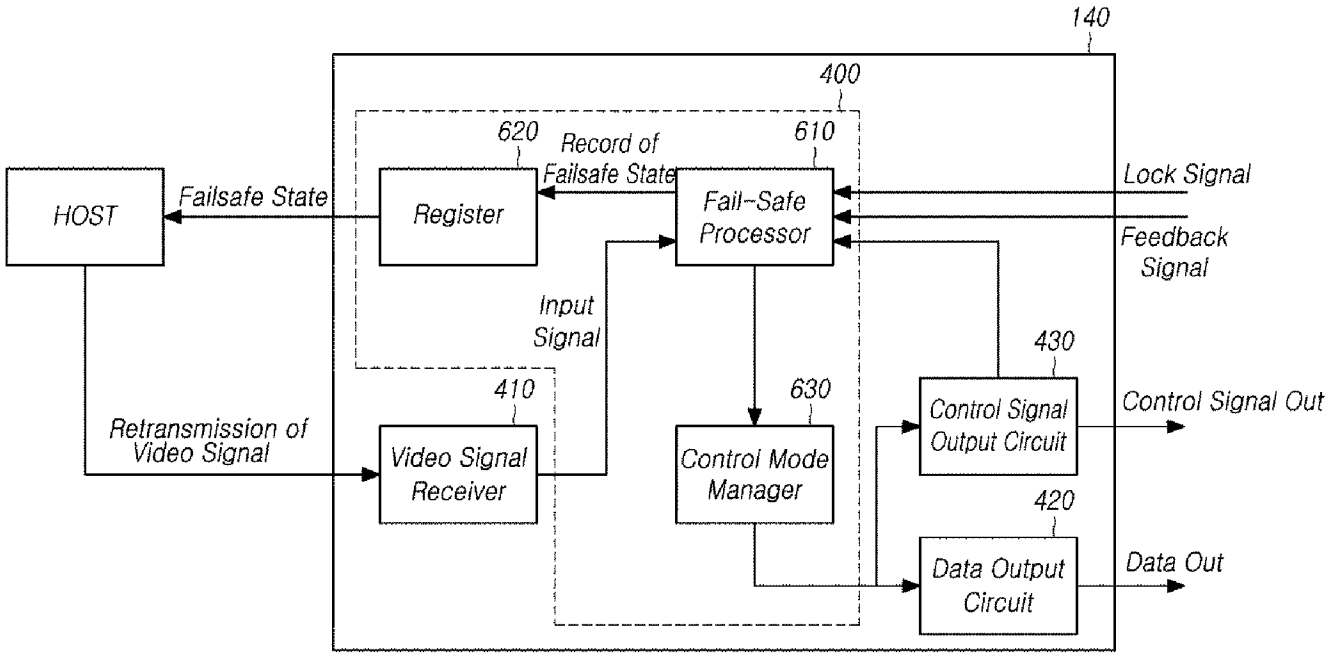
FIG. 16 is a data flow diagram illustrating the operation of the driving controller in the video input fail-safe process according to an embodiment.

FIG. 15 is a driving timing diagram related to a video input fail-safe process according to an embodiment, and FIG. 16 is a data flow diagram illustrating the operation of the driving controller 140 in the video input fail-safe process according to an embodiment.

Referring to FIGS. 15 and 16, the driving controller 140 receives a video signal from the external host 150.

In an embodiment, while a video input is being performed (i.e., the video signal is being received), the driving controller 140 performs the video input fail-safe process.

In the video input fail-safe process related to the video input, the driving controller 140 checks an input signal related to the video input received from the host 150.

The driving controller 140 may re-receive the video signal depending on the result of the checking.

The operations of receiving and re-receiving the video signal may be performed by the video signal receiver 410.

A signal monitoring operation of checking the input signal related to the video input and a control operation for re-receiving the video signal may be performed by the fail-safe processor 610 in the controller 400 of the driving controller 140.

In an embodiment, responsive to determining that the input signal has an abnormality as the result of the signal monitoring process of checking the input signal related to the video input, the driving controller 140 may re-receive the corresponding video signal. Consequently, a normal video signal may be obtained, so that normal video driving may be performed.

Referring to FIGS. 15 and 16, the driving controller 140 may check at least one among the frequency, pulse state, frame rate, frame blank section length, and the like of the input signal related to the video input, and depending on the result of the checking, re-receives the video signal.

The pulse state of the input signal checked by the driving controller 140 may include, for example, at least one among the number of pulses, the width of a high level section, the width of a low level section, a high level voltage, a low level voltage, an amplitude of the pulses, and the like.

For example, as the result of checking an input signal (e.g., a data enable (DE) signal) related to the video input, responsive to determining that the frequency of the clock signal CLOCK is not within a predetermined normal frequency range, pulses (e.g., the DE signal) are in a predetermined abnormal state, the length of a frame blank section is not within a predetermined length range, or a frame rate is not within a predetermined normal frame rate range, the driving controller 140 may determine that a failure has occurred in the input signal related to the video input, perform an input signal recovery process, and re-receive the video signal.

Referring to FIG. 15, for example, in a case in which the DE signal of the input signal is to be checked, the input signal is comprised of section A in which pulses are present, section B in which no pulses are present, and section C corresponding to a frame section, i.e., a total of section A and section B.

The driving controller 140 may recognize whether pulses are in a predetermined abnormal state by checking section A of an input signal.

For example, in the illustration of FIG. 15, it is recognized that pulses are in an abnormal state, since the number of the pulses in the second A section (to the right of FIG. 15) is less than a predetermined pulse number (e.g., of the first A section to the left of FIG. 15) when the second section A is checked.

The driving controller 140 may recognize a frame blank section (e.g., having no pulses) and recognize whether or not the length of the recognized frame blank section is within the predetermined length range by checking section B of the input signal.

The driving controller 140 may recognize the length of the frame section and thus a frame rate by checking section C of the input signal. The driving controller 140 may recognize whether the frame rate is within the predetermined normal frame rate range.

In an embodiment, the driving controller 140 may accurately monitor whether a failure has occurred in the input signal related to the video input.

After the input signal related to the video input is monitored (checked), responsive to determining that a failure has occurred in the input signal, the fail-safe processor 610 in the controller 400 of the driving controller 140 may start performing the recovery process by changing the signal level of an abnormality detection signal (e.g., Abnormal Detect Signal shown in FIG. 15) to a level indicating an abnormal state (e.g., a high level).

The fail-safe processor 610 may store the current state as a fail-safe state in the register 620 by performing the recovery process.

The host 150 may read state information stored in the register 620 and re-transmit the corresponding video signal.

The fail-safe processor 610 in the controller 400 of the driving controller 140 may transmit a request signal requesting the host 150 to read the state information stored in the register 620. In some embodiments, the host 150 may read the state information stored in the register 620 automatically or spontaneously, for example, without requiring a request signal.

In response to the request signal, the host 150 may read the state information stored in the register 620.

Alternatively, the driving controller 140 may transmit the state information, stored in the register 620, to the host 150.

Responsive to the fail-safe processor 610 in the controller 400 of the driving controller 140 changing the signal level of the abnormality detection signal to the level indicating an abnormal state (e.g., a high level), the control mode manager 630 in the controller 400 may change the control mode to a control mode related to video input fail-safe process by recognizing the abnormality detection signal.

As a result, the data output circuit 420 of the driving controller 140 may stop outputting data and wait for the video signal to be re-input.

Figure 17:
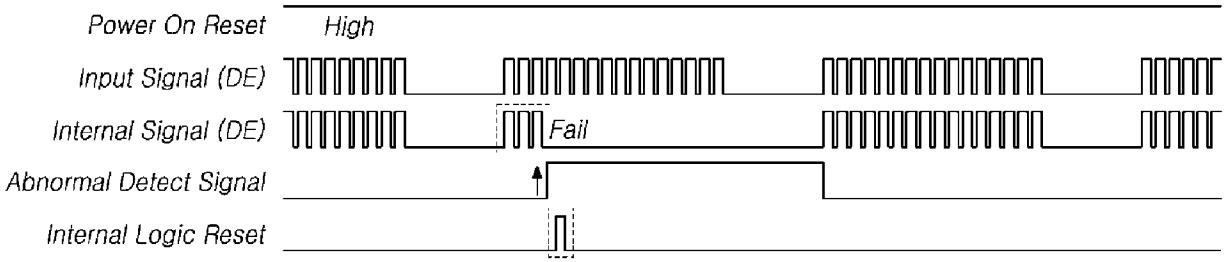
FIG. 17 is a driving timing diagram related to the internal logic fail-safe process according to an embodiment.

FIG. 17 is a driving timing diagram related to the internal logic fail-safe process according to an embodiment.

Referring to FIG. 17, while an internal signal for display driving control is being used, the driving controller 140 may perform the internal logic fail-safe process, including performing an internal signal monitoring process to monitor whether a failure has occurred in an internal signal used therein and performing a recovery process to normalize an internal logic, depending on the result of the monitoring.

In an embodiment, the driving controller 140 checks the internal signal, responsive to determining that a failure has occurred in the internal signal depending on the result of the checking, determines that an abnormality has occurred in the internal logic, and initializes (or resets) the internal logic.

More specifically, the fail-safe processor 610 in the controller 400 of the driving controller 140 may check the state of pulses included in the internal signal (e.g., a DE signal), and responsive to determining that the pulses are in an abnormal state, change the signal level of an abnormality detection signal (Abnormal Detect Signal) to a level indicating an abnormal state (e.g., a high level).

The pulse state may include at least one among the number of pulses, the width of a high level section, the width of a low level section, a high level voltage, a low level voltage, and an amplitude of the pulses.

The fail-safe processor 610 in the controller 400 may initialize the internal logic related to the internal signal.

Responsive to the fail-safe processor 610 in the controller 400 of the driving controller 140 changing the signal level of the abnormality detection signal to the level indicating an abnormal state (e.g., a high level), the control mode manager 630 in the controller 400 may change the control mode to a control mode related to the internal logic fail-safe process by recognizing the abnormality detection signal.

Additionally, the control signal output circuit 430, which stopped outputting the internal signal (i.e., an internal control signal), may resume outputting the internal signal (the internal control signal) after the internal logic is initialized.

As described above, for display driving control of the driving controller 140, the driving controller 140 may monitor whether a failure has occurred in an internal signal and an internal logic that are used internally, and responsive to determining that the failure has occurred, normalize the internal signal and the internal logic.

Figure 18:
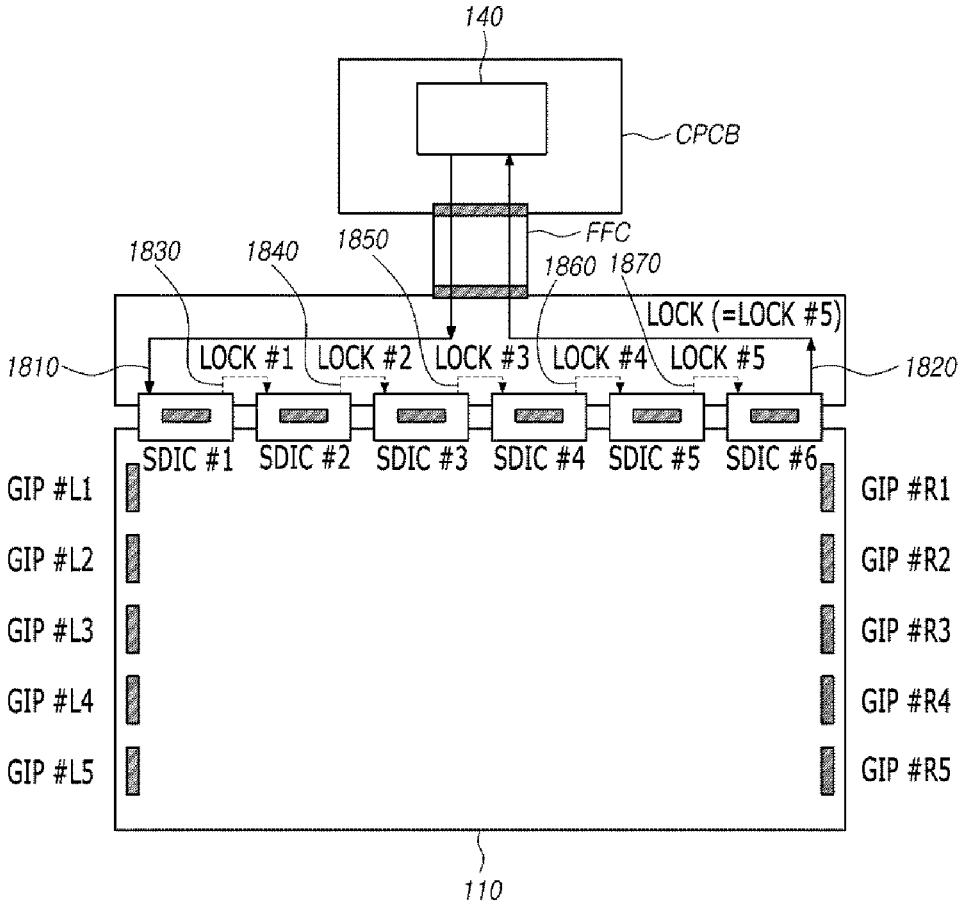
FIG. 18 illustrates a lock signal transfer line structure for the source driving fail-safe process according to an embodiment.
Figure 19:
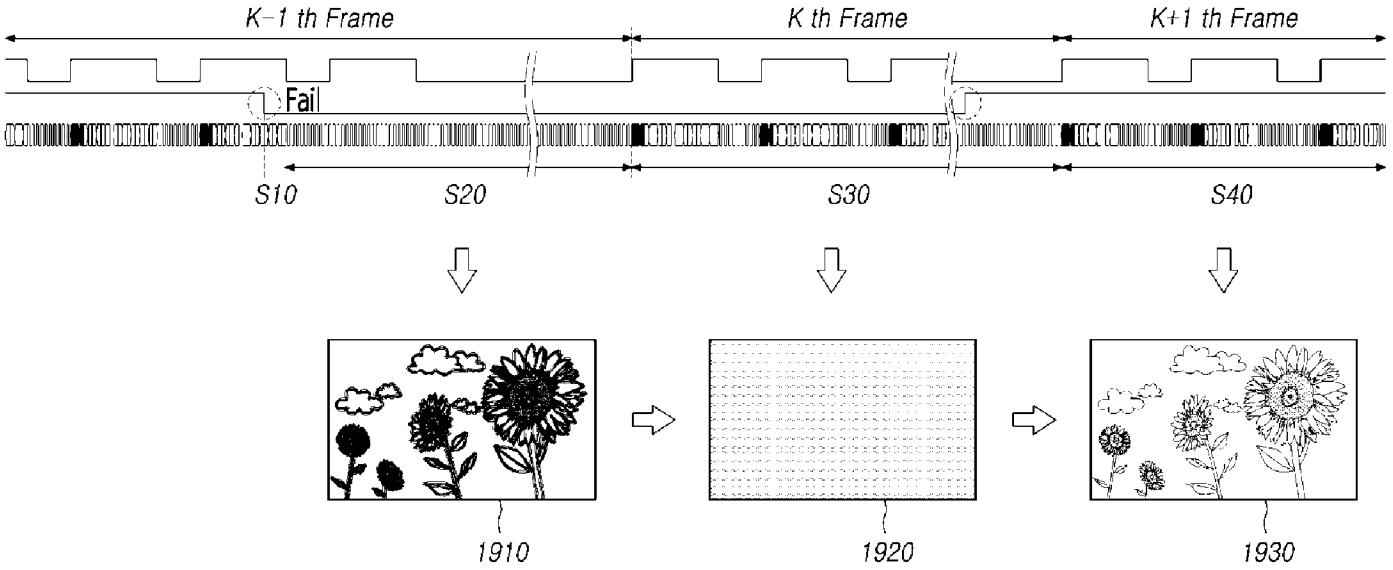
FIG. 19 illustrates a driving timing diagram related to the source driving fail-safe process, as well as a change in screen images before and after the source driving fail-safe process, according to an embodiment.

FIG. 18 illustrates a lock signal transfer line structure for the source driving fail-safe process according to an embodiment, and FIG. 19 illustrates a driving timing diagram related to the source driving fail-safe process, as well as a change in screen images before and after the source driving fail-safe process, according to an embodiment.

Referring to FIGS. 18 and 19, while source driving (or data driving) is being performed using the source driver circuit 120, the driving controller 140 may perform the source driving fail-safe process.

When the driving controller 140 performs the source driving fail-safe process in concert with the source driver circuit 120, the driving controller 140 may perform a signal monitoring process to monitor an abnormal source driving state using a lock signal LOCK received from the source driver circuit 120. Responsive to recognizing the abnormal source driving state, the driving controller 140 performs a recovery process to normalize the abnormal source driving state to a normal source driving state.

In an embodiment, the lock signal LOCK may have a high level voltage indicating a normal source driving state and a low level voltage indicating an abnormal source driving state. In another embodiment, a high level voltage indicates an abnormal source driving state and a low level voltage indicates a normal source driving state.

The voltage state of the lock signal LOCK may be determined by the source driver circuit 120 that outputs the lock signal LOCK.

When an abnormality has occurred in source driving in the source driving ICs of the source driver circuit 120 or an abnormality has occurred in source driving in at least one of the source driving ICs of the source driver circuit 120, the driving controller 140 may receive the lock signal LOCK having a low level voltage (or a high level voltage) indicating an abnormal source driving state.

The driving controller 140 may perform the recovery process by controlling display driving depending on the signal level of the lock signal LOCK received from the source driver circuit 120.

As described above, the driving controller 140 may accurately monitor the abnormal source driving state and normalize the abnormal source driving state to the normal source driving state.

The lock signal transfer method and the lock signal transfer line structure will be described with reference to FIG. 18.

In the embodiment shown in FIG. 18, the source driver circuit 120 includes six source driving ICs SDIC #1 to SDIC #6.

Referring to FIG. 18, the lock signal transfer structure includes a first lock signal line 1810 electrically connecting the first source driving IC SDIC #1 (among the six source driving ICs SDIC #1 to SDIC #6) and the driving controller 140, a second lock signal line 1820 electrically connecting the last source driving IC SDIC #6 (among the six source driving ICs SDIC #1 to SDIC #6) and the driving controller 140, and additional third lock signal lines 1830, 1840, 1850, 1860, and 1870, electrically connecting two source driving ICs, adjacent to each other, among the first to six source driving ICs SDIC #1 to SDIC #6.

Hereinafter, the lock signal transfer method will be described.

In an embodiment, the driving controller 140 outputs a lock signal or a lock signal request to the first source driving IC SDIC #1 through the first lock signal line 1810.

The first source driving IC SDIC #1 outputs a lock signal LOCK #1 indicating the source driving state thereof to the second source driving IC SDIC #2 through the third lock signal line 1830.

The lock signal LOCK #1 output from the first source driving IC SDIC #1 may have a high level voltage (or a low level voltage) indicating a normal source driving state or a low level voltage (or a high level voltage) indicating an abnormal source driving state.

In one case, after the lock signal LOCK #1 output from the first source driving IC SDIC #1 is received by SDIC #2, when the lock signal LOCK #1 output from the first source driving IC SDIC #1 has the low level voltage indicating the abnormal source driving state, the second source driving IC SDIC #2 outputs a lock signal LOCK #2 thereof, corresponding to the lock signal LOCK #1 received from the first source driving IC SDIC #1, to the third source driving IC SDIC #3 through the third lock signal line 1840.

In a different case, after the lock signal LOCK #1 output from the first source driving IC SDIC #1 is received by SDIC #2, when the lock signal LOCK #1 output from the first source driving IC SDIC #1 has the high level voltage indicating the normal source driving state, the second source driving IC SDIC #2 outputs a lock signal LOCK #2 indicating the source driving state thereof to the third source driving IC SDIC #3 through the third lock signal line 1840.

The lock signal LOCK #2 output from the second source driving IC SDIC #2 may have the high level voltage (or low level voltage) indicating the normal source driving state or the low level voltage (or high level voltage) indicating the abnormal source driving state.

In one case, after the lock signal LOCK #2 output from the second source driving IC SDIC #2 is received by SDIC #3, when the lock signal LOCK #2 output from the second source driving IC SDIC #2 has the low level voltage indicating the abnormal source driving state, the third source driving IC SDIC #3 outputs a lock signal LOCK #3 thereof, corresponding to the lock signal LOCK #2 received from the second source driving IC SDIC #2, to the fourth source driving IC SDIC #4 through the third lock signal line 1850.

In a different case, after the lock signal LOCK #2 output from the second source driving IC SDIC #2 is received by SDIC #3, when the lock signal LOCK #2 output from the second source driving IC SDIC #2 has the high level voltage indicating the normal source driving state, the third source driving IC SDIC #3 outputs a lock signal LOCK #3 indicating the source driving state thereof to the fourth source driving IC SDIC #4 through the third lock signal line 1850.

The lock signal LOCK #3 output from the third source driving IC SDIC #3 may have the high level voltage (or low level voltage) indicating the normal source driving state or the low level voltage (or high level voltage) indicating the abnormal source driving state.

In one case, after a lock signal LOCK #5 output from the fifth source driving IC SDIC #5 is received by SDIC #6 in the cascade method as described above, when the lock signal LOCK #5 output from the fifth source driving IC SDIC #5 has the low level voltage indicating the abnormal source driving state, the sixth source driving IC SDIC #6 outputs a final lock signal LOCK, i.e., corresponding to the lock signal LOCK #5 received from the fifth source driving IC SDIC #5, to the driving controller 140 through the second lock signal line 1820.

In a different case, when the lock signal LOCK #5 output from the fifth source driving IC SDIC #5 has the high level voltage indicating the normal source driving state, the sixth source driving IC SDIC #6 outputs a final lock signal LOCK, i.e., a lock signal indicating the source driving state thereof, to the driving controller 140 through the second lock signal line 1820.

The final lock signal LOCK output from the sixth source driving IC SDIC #6 may have the high level voltage (or low level voltage) indicating the normal source driving state or the low level voltage (or high level voltage) indicating the abnormal source driving state.

Thus, in an embodiment, when all of the source driving states of the six source driving ICs SDIC #1 to SDIC #6 are normal, the final lock signal LOCK received by the driving controller 140 has the high level voltage (or low level voltage) indicating the normal source driving state.

On the other hand, when at least one source driving IC among the six source driving ICs SDIC #1 to SDIC #6 is abnormal, the final lock signal LOCK received by the driving controller 140 has the low level voltage (or high level voltage) indicating the abnormal source driving state.

Due to the lock signal transfer line structure as described above, the driving controller 140 may determine the overall source driving state of the source driver circuit 120 by receiving the lock signal LOCK indicating the overall source driving state of source driving ICs SDIC #1 to SDIC #6.

After the overall source driving state of the source driver circuit 120 is determined, as described above, responsive to determining that the source driving state is the abnormal source driving state, the driving controller 140 may perform the recovery process to normalize the abnormal source driving state.

Referring to FIG. 19, in period S10, after the signal monitoring process as described above is performed during a (K−1)th frame section, responsive to determining that a lock signal indicating an abnormal source driving state is received, the driving controller 140 determines that the source driving state is the abnormal source driving state.

In an embodiment, in a lock signal recovery section S20, the driving controller 140 attempts to recover the lock signal by a clock training operation, for example, by only outputting a clock signal without outputting video data.

The lock signal recovery section S20 corresponds to a period of time.

In a mode setting recovery section S30 corresponding to the next Kth frame section, the driving controller 140 may transmit a control packet to the source driving ICs SDIC #1 to SDIC #6.

The Kth frame section in which the control packet is transmitted to the source driver circuit 120 is the mode setting recovery section S30 in which an attempt to recover the mode setting of the source driving ICs SDIC #1 to SDIC #6 is performed.

During the mode setting recovery section S30, the driving controller 140 may transmit data for displaying a source recovery section image 1920 (e.g., black data) when transmitting the control packet through a video data transmission channel.

Thus, responsive to determining that the signal level of the lock signal LOCK received from the source driver circuit 120 in S10 has remained in an abnormal level for a predetermined period of time, the display driving can be controlled so that a source driving recovery section image 1920 is displayed on the display panel 110 during the mode setting recovery section S30. The source driving recovery section image 1920 may be, for example, a black screen image.

While the lock signal checking section S10, the lock signal recovery section S20, or the mode setting recovery section S30 are proceeding, responsive to determining a change of the lock signal to the high level voltage indicating the normal source driving state as illustrated in FIG. 19, the driving controller 140 may output video data for normal source driving.

While the lock signal checking section S10, the lock signal recovery section S20, or the mode setting recovery section S30 are proceeding, responsive to determining that the lock signal does not change to the high level voltage indicating the normal source driving state, the driving controller 140 may repeat the lock signal recovery section S20 and the mode setting recovery section S30.

Example changes in the screen images by the performance of the source driving fail-safe process, as described above, are as follows.

In the abnormal source driving state, an abnormal screen image 1910 is displayed on the display panel 110.

The abnormal screen image 1910 is displayed on the display panel 110 before, or directly before, the mode setting recovery section S30.

In the mode setting recovery section S30, responsive to the driving controller 140 transmitting the data for displaying the source recovery section image 1920 (e.g., black data) on the control packet transmitted through the video data transmission channel, the abnormal screen image 1910 changes to the source driving recovery section image 1920, such as a black screen image.

As the mode setting recovery section S30 proceeds, responsive to detecting that the lock signal changes to the high level voltage indicating the normal source driving state, the driving controller 140 changes the source driving recovery section image 1920, such as the black screen image, to a normal screen image 1930.

As described above, during the recovery period in which the source driving recovery process is being performed, the source driving recovery section image 1920 that may be a completely black screen image or a black screen image having a low grayscale of a predetermined level or lower is displayed on the display panel 110. Consequently, the abnormal screen image 1910 is not displayed any further, and the user may recognize that the display device 100 is being recovered from the display-related problem.

Hereinafter, a driving method for performing the gate driving fail-safe process among the above-described fail-safe processes will be described briefly with reference to FIG. 20.

Figure 20:
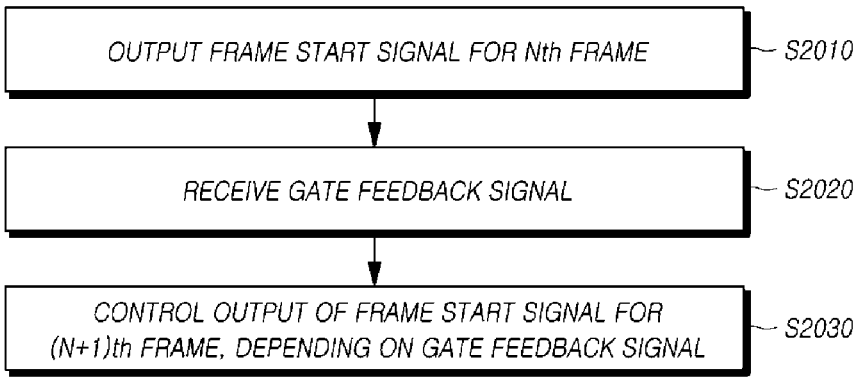
FIG. 20 is a flowchart illustrating a method of driving a display device according to an embodiment.

FIG. 20 is a flowchart illustrating a method of driving the display device 100 according to an embodiment.

Referring to FIG. 20, the method of driving the display device 100 according to an embodiment includes: step S2010 of outputting, by the driving controller 140, a frame start signal FSS for an Nth frame (N≥1); step S2010 of receiving, by the driving controller 140, a (gate) feedback signal FBS in a frame blank section; and step S2030 of controlling, by the driving controller 140, output of a frame start signal FSS for an (N+1)th frame, depending on whether or not the (gate) feedback signal FBS has been received or based on the state of the (gate) feedback signal FBS. For example, the driving controller 140 may determine to not output the frame start signal FSS for the (N+1)th frame.

The driving controller 140 may receive the feedback signal FBS, the high voltage of which is lower than a high level gate voltage.

Step S2030 may proceed for a section corresponding to a predetermined number of frames.

While step S2030 is proceeding, a clock signal CLOCK may be normally output by the driving controller 140 due to gate-on sequence processing.

After step S2030, the process may be repeated from step S2010.

When the above-described driving method is used, the driving controller 140 may determine whether the gate driving state is an abnormal driving state in the current frame section, and responsive to determining that the gate driving state is the abnormal driving state, abnormal gate driving can be prevented from being performed in the next frame section. This can consequently prevent abnormal screen images that would otherwise be caused by abnormal gate driving.

The screen driving related to the performance of the above-described fail-safe process will be further described.

In an embodiment, an abnormal screen image is displayed on the display panel 110 due to an abnormal gate driving state, an abnormal video input state, an abnormal internal logic state, or an abnormal source driving state.

Based on a signal to be monitored (e.g., a feedback signal, a lock signal, or an abnormality detection signal) received externally or internally by the signal monitoring in the fail-safe process, the driving controller 140 performs the recovery process in response to the signal. In this process, a screen image (i.e., a recovery section image) different from the abnormal screen image and the normal screen image is displayed on the display panel 110.

Responsive to the driving controller 140 normalizing the abnormal state by the fail-safe process, a normal screen image is displayed on the display panel 110.

Since the screen driving is performed to display the recovery screen image during the performance of the fail-safe process as described above, the abnormal screen image is not displayed any further, and the user may recognize that the display device 100 is being recovered from the display-related problem.

According to the embodiments as set forth above, the driving controller 140 may effectively and accurately monitor the operating states of the driving-related circuits 120, 130, and 140, and when an abnormality has been occurred in any one of the circuits, the driving controller 140 may rapidly and accurately normalize the operation of the corresponding circuit.

According to some embodiments, the driving controller 140 may normalize an abnormal gate driving state by accurately and rapidly monitoring the gate driving state.

According to some embodiments, the driving controller 140 may normalize an abnormal video input state by accurately and rapidly monitoring the video input state.

According to some embodiments, the driving controller 140 may normalize an abnormal driving control internal logic by accurately and rapidly monitoring the driving control internal logic.

According to some embodiments, the driving controller 140 may normalize an abnormal source driving state by accurately and rapidly monitoring the source driving state.

According to some embodiments, the driving controller 140 may significantly improve the quality of images by performing synthetic, systemized, and robust fail-safe processing on a number of display driving elements influential in displaying images on the screen.

According to some embodiments, the driving controller 140 may improve the quality of overall images of the display panel 110 by rapidly monitoring an abnormal state in both row driving (e.g., gate driving) and column driving (e.g., source driving) of the display panel 110.

The foregoing descriptions and the accompanying drawings have been presented in order to explain the certain principles of the present disclosure. A person skilled in the art to which the present disclosure relates could make many modifications and variations by combining, dividing, substituting for, or changing the elements without departing from the principle of the present disclosure. The foregoing embodiments disclosed herein shall be interpreted as illustrative only but not as limitative of the principle and scope of the present disclosure. It should be understood that the scope of the present disclosure shall be defined by the appended Claims and all of their equivalents fall within the scope of the present disclosure.

What is claimed is:

1. A display device comprising:

a display panel having an arrangement of a plurality of data lines and an arrangement of a plurality of gate lines;

a source driver circuit driving the plurality of data lines;

a gate driver circuit driving the plurality of gate lines; and a driving controller configured for:

outputting a first frame start signal to the gate driver circuit for a first frame;

responsive to determining that a first feedback signal received in a first frame blank section of the first frame is in a first state, outputting a second frame start signal for a second frame to the gate driver circuit;

responsive to determining that a second feedback signal has not been received in a second frame blank section for a third frame or the received second feedback signal is in a second state, not outputting a third frame start signal for a fourth frame to the gate driver circuit; and performing a gate driving recovery process during a period of time of at least one frame, wherein the driving controller does not output any frame start signals during the gate driving recovery process.

2. The display device according to claim 1, further comprising feedback signal lines coupled to the driving controller and through which the first feedback signal is delivered.

3. The display device according to claim 1, wherein the gate driver circuit comprises a plurality of panel-mounted gate driver chips, the first frame start signal for the first frame is output from the driving controller to a first panel-mounted gate driver chip of the plurality of panel-mounted gate driver chips, and the first feedback signal is transmitted to the driving controller by a second panel-mounted gate driver chip of the plurality of panel-mounted gate driver chips.

4. The display device according to claim 3, wherein the first frame start signal for the first frame is output from the driving controller to the first panel-mounted gate driver chip of the plurality of panel-mounted gate driver chips, and is delivered, in cascade form, from the first panel-mounted gate driver chip to the second panel-mounted gate driver chip, and the second panel-mounted gate driver chip transmits the first frame start signal for the first frame, as the first feedback signal, to the driving controller.

5. The display device according to claim 3, further comprising:

a circuit film on which a source driving integrated circuit is mounted;

a source printed circuit board electrically connected to the display panel via the circuit film;

a control printed circuit board electrically connected to the source printed circuit board via a connector member, wherein the driving controller is mounted on the control printed circuit board; and feedback signal lines electrically connecting the driving controller and the second panel-mounted gate driver chip, wherein the feedback signal lines are arranged on the display panel, the circuit film, the source printed circuit board, and the control printed circuit board.

6. The display device according to claim 1, wherein the driving controller is further configured to:

check that the first feedback signal has been received, responsive to determining that the first feedback signal comprises normal pulses corresponding to the first state based on a predetermined reference, as a result of the checking, determine a gate driving state to be normal and output the second frame start signal for the second frame to the gate driver circuit, and responsive to determining that the second feedback signal has not been received or the second feedback signal comprises abnormal pulses corresponding to the second state based on the predetermined reference, determine the gate driving state to be abnormal and determine to not output the third frame start signal for the fourth frame to the gate driver circuit.

7. The display device according to claim 6, wherein, responsive to determining that the first feedback signal is comprised of K number of pulses, where $K \geq 1$, a first amplitude or a first voltage of the first feedback signal is within a predetermined normal amplitude range or predetermined normal voltage range, respectively, or a first pulse width of the first feedback signal is within a predetermined normal pulse width range, the driving controller determines that the first feedback signal comprises the normal pulses, and responsive to determining that the second feedback signal has not been received, the second feedback signal comprises a number of pulses less than K or equal to or greater than K+1, a second amplitude or a second voltage of the second feedback signal is not within the predetermined normal amplitude range or the predetermined normal voltage range, respectively, or a second pulse width of the second feedback signal is not within the predetermined normal pulse width range, the driving controller determines that the second feedback signal comprises the abnormal pulses.

8. The display device according to claim 1, wherein the driving controller is further configured to:

output a fourth frame start signal for a fifth frame to the gate driver circuit responsive to performing the gate driving recovery process, and re-perform the gate driving recovery process responsive to determining that a third feedback signal has not been received or an abnormal feedback signal has been received during a third frame blank section of the fifth frame.

9. The display device according to claim 1, wherein a recovery section image different from a normal screen image is displayed on the display panel during a period of time of at least one frame after a point in time at which the third frame start signal for the fourth frame is not output.

10. The display device according to claim 9, wherein the recovery section image is a black screen image.

11. The display device according to claim 1, wherein a first amplitude or a first voltage of the first feedback signal received by the driving controller is less than a second amplitude or a second voltage, respectively, of the second frame start signal output to the gate driver circuit.

12. The display device according to claim 11, further comprising a signal adjuster for adjusting the first amplitude or the first voltage of the first feedback signal received by the driving controller.

13. The display device according to claim 1, wherein the driving controller checks an input signal related to video input, and depending on a result of the checking, re-receives a video signal.

14. The display device according to claim 13, wherein the driving controller checks the input signal related to the video input by checking at least one among a frequency, a pulse state, a frame rate, and a frame blank section length of the input signal related to the video input.

15. The display device according to claim 14, wherein the pulse state comprises at least one among a number of pulses, a width of a high level section, a width of a low level section, a high level voltage, a low level voltage, and an amplitude.

16. The display device according to claim 1, wherein the driving controller controls display driving depending on a signal level of a lock signal received from the source driver circuit.

17. The display device according to claim 16, wherein the driving controller controls the display driving to display a recovery section image different from a normal screen image on the display panel responsive to determining that the signal level of the lock signal received from the source driver circuit has remained at an abnormal level for a predetermined period of time.

18. The display device according to claim 17, wherein the recovery section image is a black screen image.

19. The display device according to claim 16, wherein the source driver circuit comprises a plurality of source driving integrated circuits, the display device further comprising:

a first lock signal line electrically connecting a first source driving integrated circuit of the plurality of source driving integrated circuits and the driving controller;

a second lock signal line electrically connecting a second source driving integrated circuit of the plurality of source driving integrated circuits and the driving controller; and third lock signal lines electrically connecting two source driving integrated circuits, adjacent to each other, of the plurality of source driving integrated circuits.

20. The display device according to claim 1, wherein the driving controller is further configured to check an internal signal, and based on a result of the checking, initialize an internal logic.

21. The display device according to claim 1, wherein the second frame is consecutive to the first frame, and the fourth frame is consecutive to the third frame.

22. The display device according to claim 1, wherein the second frame and the third frame are a same frame.

23. The display device according to claim 1, wherein the driving controller outputs only clock signal in the gate driving recovery process.

24. A driving controller comprising:

a control signal output circuit outputting a first frame start signal for a first frame; and a controller configured for:

after the frame start signal for the first frame is output, outputting a second frame start signal for a second frame responsive to determining that a first feedback signal received in a first frame blank section of the first frame is in a first state, not outputting a third frame start signal for a third frame responsive to determining that a second feedback signal has not been received in a second frame blank section or the second feedback signal is in a second state, and performing a gate driving recovery process during a period of time of at least one frame, wherein the driving controller does not output any frame start signals during the gate driving recovery process.

25. A method of driving a display device comprising a display panel having an arrangement of a plurality of data lines and an arrangement of a plurality of gate lines, a source driver circuit driving the plurality of data lines, and a gate driver circuit driving the plurality of gate lines, the method comprising:

outputting, by a driving controller, a first frame start signal for a first frame;

waiting a duration of time, by the driving controller, for a first feedback signal to be received in a first frame blank section of the first frame;

outputting, by the driving controller, a second frame start signal for a second frame responsive to determining that the first feedback signal received in the first frame blank section is in a first state; and responsive to determining that a second feedback signal has not been received in a second frame blank section for a third frame or the second feedback signal is in a second state, not outputting, by the driving controller, a third frame start signal for a fourth frame, and performing a gate driving recovery process during a period of time of at least one frame, wherein the driving controller does not output any frame start signals during the gate driving recovery process.

26. The method according to claim 25, wherein determining to not output the third frame start signal is performed during a period of time of at least one frame during which a clock signal not output.

* * * * *